US006515692B2

(12) United States Patent
Koga et al.

(10) Patent No.: US 6,515,692 B2
(45) Date of Patent: Feb. 4, 2003

(54) IMAGE FORMING APPARATUS HAVING WRITING ELECTRODES AS A WRITING DEVICE

(75) Inventors: Yoshiro Koga, Nagano-Ken (JP); Shinichi Kamoshida, Nagano-Ken (JP); Kaneo Yoda, Nagano-Ken (JP); Nobumasa Abe, Nagano-Ken (JP); Yujiro Nomura, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/966,989

(22) Filed: Oct. 1, 2001

(65) Prior Publication Data

US 2002/0047886 A1 Apr. 25, 2002

(30) Foreign Application Priority Data

Sep. 29, 2000 (JP) ..... 2000-298925
Sep. 29, 2000 (JP) ..... 2000-298927
Jul. 27, 2001 (JP) ..... 2001-227630

(51) Int. Cl.[7] ..... B41J 2/41
(52) U.S. Cl. ..... 347/117; 347/141; 347/147
(58) Field of Search ..... 347/141–150, 347/115, 117; 346/139 C

(56) References Cited

U.S. PATENT DOCUMENTS 4,237,469 A * 12/1980 Gustin et al. ..... 347/148
4,468,681 A * 8/1984 Wako et al. ..... 347/141
5,842,087 A * 11/1998 Matsushita et al. ..... 399/174

FOREIGN PATENT DOCUMENTS

JP 63-45104 B2 9/1988 ..... G03G/15/00
JP 6-166206 6/1994 ..... B41J/2/415

* cited by examiner

*Primary Examiner*—Joan Pendegrass
(74) *Attorney, Agent, or Firm*—Sughrue Mion, PLLC

(57) ABSTRACT

Writing electrodes of a writing device are kept in contact with a latent image carrier with a small pressing force by a weak restoring force of a substrate. An electrostatic latent image is written on the latent image carrier by applying or removing charge relative to the latent image carrier which is already uniformly charged by a charge control device. The application or removal of charge is conducted via charge-transfer between the latent image carrier and the writing electrodes which are in contact with each other. The electrostatic latent image is developed by a developing device to form a developing powder image and this developing powder image is transferred to a receiving medium such as a paper by a transferring device. Since the writing electrodes are employed as the writing device, the apparatus can be manufactured smaller and simply and can steadily write an image.

13 Claims, 18 Drawing Sheets

(b)

(a)

(c)

(d)

(a)

(b)

IMAGE FORMING APPARATUS HAVING WRITING ELECTRODES AS A WRITING DEVICE

BACKGROUND OF THE INVENTION

The present invention relates to an image forming apparatus which forms an electrostatic latent image onto a latent image carrier by using writing electrodes of a writing device, thereby forming the image.

In a conventional image forming apparatus such as an electrostatic copier and a printer, the surface of a photoreceptor (photosensitive member) is uniformly charged by a charging device and the charged surface is then exposed to light from an exposure device such as laser beam or LED light, whereby a latent image is written on the surface of the photoreceptor. Then, the latent image on the surface of the photoreceptor is developed by a developing device to form a developing powder image on the surface of the photoreceptor. The developing powder image is transferred to a receiving medium such as a paper, thereby forming the image.

In such conventional image forming apparatus, the exposure device as a writing device for electrostatic latent image comprises a laser beam generating device or a LED light generating device. Therefore, the entire image forming apparatus should be large and complex.

Therefore, an image forming apparatus has been proposed in Japanese Patent Publication No. S63-45104 (hereinafter, '104B publication) which employs electrodes, as a writing device for forming an electrostatic latent image, to write an electrostatic latent image on a surface of a latent image carrier without using laser beams and LED lights.

The image forming apparatus disclosed in the '104B publication is provided with a multistylus having a large number of needle electrodes. The needle electrodes are just arranged in contact with an inorganic glass layer on the surface of the latent image carrier. In accordance with an input signal for image information, voltages are selectively applied to corresponding ones of the needle electrodes of the multistylus, whereby the electrostatic latent image can be formed on the latent image carrier. Since the image forming apparatus according to the '104B publication does not use an exposure device conventionally used as a writing device, the invention of this publication can provide an image forming apparatus which is relatively small in size and relatively simple in structure.

In addition, an image forming apparatus has been proposed in Japanese Unexamined Patent Publication No. H06-166206 (hereinafter, '206A publication), comprising ion control electrodes which are disposed on a front end portion of an insulating substrate and are arranged in non-contact with a latent image carrier, wherein the ion control electrodes control ions produced by a corona discharger so as to write an electrostatic latent image on the latent image carrier. Since the image forming apparatus according to the '206A publication also does not use an exposure device as a writing device, the invention of this publication can provide an image forming apparatus which is relatively small in size and relatively simple in structure.

However, in the image forming apparatus according to the '104B publication, the large number of needle electrodes of the multistylus are just arranged in contact with the inorganic glass layer on the surface of the latent image carrier. It is difficult to keep the stable contact between the needle electrodes and the inorganic glass layer on the surface of the latent image carrier. Accordingly, it is difficult to stably charge the surface of the latent image carrier. This means that it is hard to obtain a high quality image.

Moreover, it is unavoidable to employ an inorganic glass layer on the surface of the latent image carrier for protecting the surface of the latent image carrier from damage due to contacts of a large number of the needle electrodes. This makes the structure of the latent image carrier more complex. In addition, since the inorganic glass layer has quite well physical adsorbed water characteristic, moisture is easily adsorbed by the surface of the inorganic glass layer. Due to the moisture, the electrical conductivity of the glass surface is increased so that electrostatic charge on the latent image carrier should leak. Therefore, the image forming apparatus should be provided with a means for drying the surface of the latent image carrier with adsorbed moisture in order to prevent the apparatus from being affected by absorbed water. This not only makes the apparatus larger but also increases the number of parts, leading to problems of making the structure further complex and increasing the cost.

Since the large number of needle electrodes discharge, the apparatus has another problem that there is a high possibility of generation of ozone ($O_3$). The presence of ozone may not only produce rusts on parts in the apparatus but also melt resin parts because ozone reacts with $NO_x$ to generate nitrous acid ($HNO_3$). Again ozone may give an offensive smell. Therefore, the image forming apparatus should be provided with an ventilation system including a duct and an ozone filter which sufficiently exhausts ozone from the inside of the apparatus. This also not only makes the apparatus larger but also increases the number of parts, leading to problems of making the structure further complex and increasing the cost.

On the other hand, in the image forming apparatus according to the '206A publication, ions produced by the corona discharger are controlled by the ion control electrodes. This means that the apparatus is structured not to directly apply electric charge to the latent image carrier. The invention of the '206A publication has problems of not only making the image forming apparatus larger and but also making the structure complex. Since the charge is conducted by ions, it is difficult to stably write a latent image on the latent image carrier.

Further, since the generation of ions essentially generates ozone, there are problems similar to those described with regard to the image forming apparatus according to '104B publication.

SUMMARY OF THE INVENTION

It is an object of the present invention to provide an image forming apparatus capable of more stably writing an electrostatic latent image and yet achieving reduction in size and reduction in the number of parts thereof so as to have more simple and low-price structure.

It is another object of the present invention to provide an image forming apparatus capable of further preventing generation of ozone.

In order to achieve these objects, the present invention provides an image forming apparatus which comprises at least: a latent image carrier on which an electrostatic latent image is formed, a writing device for writing said electrostatic latent image on said latent image carrier, and a developing device for developing said electrostatic latent image on said latent image carrier, wherein said electrostatic latent image, written on said latent image carrier by said writing device, is developed by said developing device, thereby forming an image, and is characterized in that said writing device has writing electrodes which are in plane contact with a charged layer of said latent image carrier to write said electrostatic latent image.

The present invention is characterized in that said writing electrodes are supported by a substrate having elasticity and are kept in contact with said latent image carrier by a small pressing force due to the elasticity of said substrate.

Further, the present invention is characterized in that said writing electrodes write said electrostatic latent image on said latent image carrier by applying charge to said latent image carrier.

Furthermore, the present invention is characterized in that said writing electrodes write said electrostatic latent image on said latent image carrier by removing charge from said latent image carrier.

The present invention is still characterized in that said writing electrodes are controlled to be connected to either high voltage or low voltage by switching operation in accordance with the image to be formed, thereby writing said electrostatic latent image on said latent image carrier.

The present invention is still further characterized in that the resistance value of said each writing electrode is set at a value smaller than the resistance value of said charged layer.

Further, the present invention is characterized in that the resistance value of said each writing electrode is set at $10^8$ Ω cm or less.

Furthermore, the present invention is characterized in that the resistance value of said each writing electrode is set at $10^6$ Ω cm or more.

Moreover, the present invention is characterized in that the resistance value of said charged layer is set at $\mathbf{10^9}$ Ω cm or less.

The present invention is still characterized in that said each writing electrode is provided with a resistive layer at its conductive portion so that said writing electrode is formed in a multi-layered structure, wherein said resistive layer of said writing electrode is in contact with said latent image carrier.

The present invention is still further characterized in that said writing device and said developing device are provided for every color of black, yellow, magenta, and cyan, whereby a multicolored developing powder image is formed by superposing respective color developing powder images which are formed by said writing devices for the respective colors and said developing devices for the respective colors.

Moreover, the present invention is characterized in that said latent image carrier, said writing device, and said developing device are provided for every color of black, yellow, magenta, and cyan, whereby four image forming units for the respective colors are provided, said image forming units being arranged in tandem.

In addition, the present invention is characterized by further comprising an intermediate transferring device, to which respective color developing powder images are temporally transferred by said image forming units for the respective colors.

In the image forming apparatus of the present invention, charge-transfer between the writing electrodes and the latent image carrier which are in contact with each other are dominant because the writing electrodes are in plane contact with the latent image carrier, thereby stably and reliably conducting the charge-transfer between the writing electrodes and the latent image carrier. This dominant charge-transfer enables easy writing of an electrostatic latent image on the latent image carrier.

In the application or removal of charge via charge-transfer, since charge is directly transferred between the writing electrodes and the latent image carrier which are in contact with each other, the surface potential of the latent image carrier becomes substantially equal to the voltage to be impressed to the writing electrodes. Therefore, the voltage to be impressed to the writing electrodes is allowed to be set at a relatively low voltage.

The writing electrodes are supported by the substrate having elasticity and are kept in contact with the latent image carrier with a small pressing force by weak elastic restoring force of the substrate, thereby stabilizing the positions of the writing electrodes relative to the latent image carrier and thus stably and reliably conducting charge-transfer between the writing electrodes and the latent image carrier. Therefore, application or removal of charge relative to the latent image carrier by the writing electrodes can be further stably conducted with high precision, thereby achieving stable writing of an electrostatic latent image and thus reliably obtaining a high quality image with high precision.

Since the writing electrodes can be kept in contact with the latent image carrier with a small pressing force as mentioned above, there is little or no gap (space) between the writing electrodes and the latent image carrier. Because of the little or no gap, air undesirably ionized is practically non-existent, thereby further reducing the generation of ozone and enabling the formation of an electrostatic latent image with low potential. Since the writing electrodes are kept in contact with the latent image carrier by a small pressing force, the latent image carrier can be prevented from being damaged by the writing electrodes, thus improving the durability of the latent image carrier.

Further, since the resistance of the writing electrode is set to be a value equal or less than the resistance of the charged layer of the latent image carrier, the speed of charge response during latent image formation is hard to be affected by resistive components adhering to the surface layer of the writing electrode because the resistance of the charged layer is greater than the resistance of the writing electrode.

By setting the resistance value of the writing electrode at $10^8$ Ω cm or less, a predetermined time constant can be ensured, thus achieving uniform charge. On the other hand, by setting the resistance value of the writing electrode at $10^6$ Ω cm or more, the electrostatic breakdown due to pin holes of the charged layer of the latent image carrier can be prevented. It should be understood that this lower limit of the resistance may be lower if a blocking layer (thin insulating layer) is provided on the latent image carrier.

The setting of the resistance of the charged layer at $10^9$ Ω cm or less can facilitate application of charge which is conducted through the contact charge-transfer between the electrode and the latent image carrier which are in contact with each other.

Furthermore, the writing electrode is provided with the resistant layer on the conductive portion, thereby preventing the broadening of the contact charge-transfer in the lateral direction. This achieves effective contact charge-transfer between the writing electrode and the latent image carrier which are in contact with each other.

Moreover, the writing device employs only the writing electrodes without using a laser beam generating device or a LED light generating device which is large in size as conventionally used. The apparatus size can be reduced and the number of parts can also be reduced, thereby obtaining an image forming apparatus which is simple and low-price.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

The embodiments of the present invention will be described hereinafter with reference to the drawings.

Figure 1:
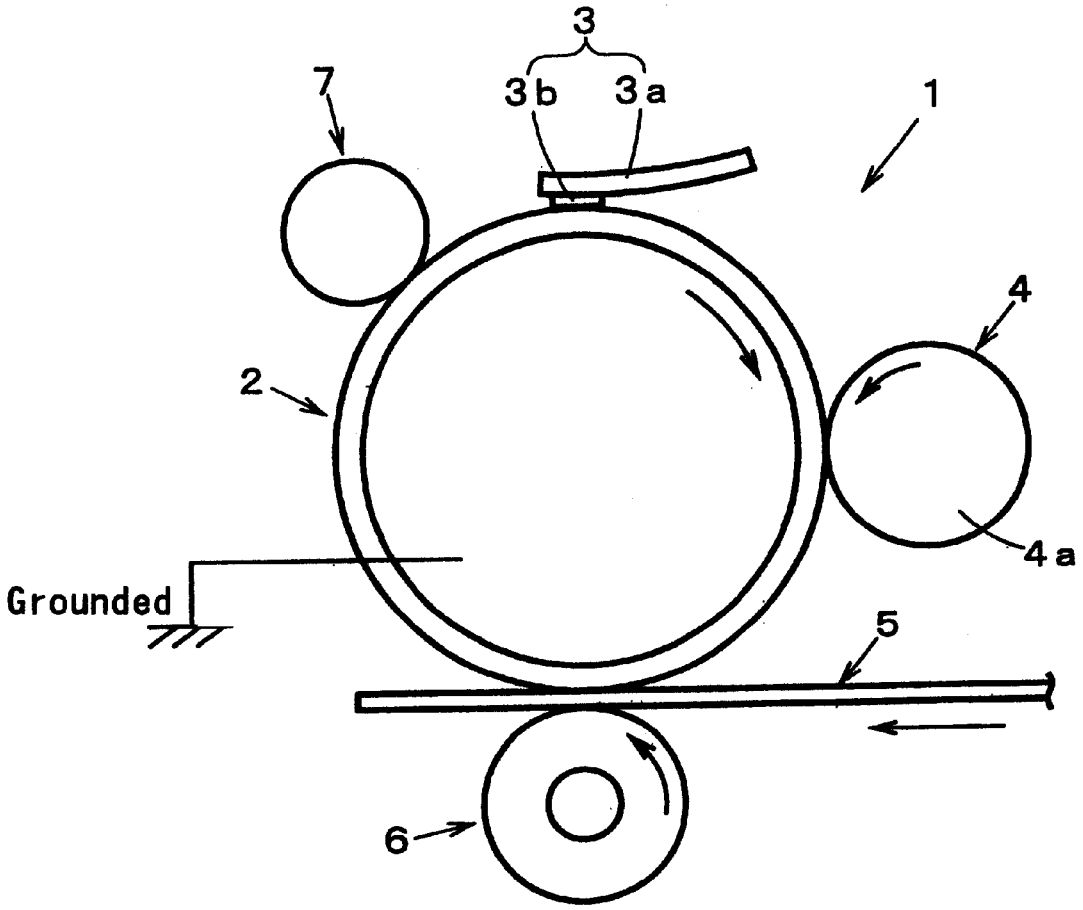
FIG. 1 is a schematic illustration of the basic structure of an image forming apparatus in accordance with the present invention.

FIG. 1 is a schematic illustration of the basic structure of an image forming apparatus in accordance with the present invention.

As shown in FIG. 1, an image forming apparatus 1 according to the present invention comprises, at least, a latent image carrier 2 on which an electrostatic latent image is formed, a writing device 3 which is arranged in contact with the latent image carrier 2 to write the electrostatic latent image on the latent image carrier 2, a developing device 4 which develops the electrostatic latent image on the latent image carrier 2 with developing powder carried and conveyed by a developing powder carrier 4*a*, a transferring device 6 which transfers a developing powder image on the latent image carrier 2, developed by the developing device 4, to a receiving medium 5 such as a paper, and a charge control device 7 which makes the surface of the latent image carrier 2 into the uniformly charged state by removing any residual charge from the latent image carrier 2 after the transfer of the latent image or by charging (i.e. applying charge to) the latent image carrier 2 after the transfer of the electrostatic latent image.

Though the following description will be made assuming that the latent image carrier 2 is grounded, this is for the purpose of facilitating the description only and not of limitation. That is, the latent image carrier may not be grounded.

The writing device 3 comprises a flexible substrate 3*a*, having high insulation property and being relatively soft and elastic, such as a FPC (Flexible Print Circuit: hereinafter, referred to as "FPC") or a PET (polyethylene terephthalate: hereinafter, referred to as "PET"), and writing electrodes 3*b* which are supported by the substrate 3*a* and which are pressed lightly against the latent image carrier 2 with weak elastic restoring force created by deflection of the substrate 3*a* so that the writing electrodes 3*b* are in contact with the latent image carrier 2 so as to write the electrostatic latent image.

In the image forming apparatus 1 having a structure as mentioned above, after the surface of the latent image carrier 2 is made into the uniformly charged state by the charge control device 7, an electrostatic latent image is written on the uniformly charged surface of the latent image carrier 2 by charge-transfer between the latent image carrier 2 and the writing device 3 which are in contact with each other (hereinafter, referred to as "contact charge-transfer"). Then, the electrostatic latent image on the latent image carrier 2 is developed with developing powder of the developing device 4 to form a developing powder image and the developing powder image is transferred to the receiving medium 5 by the transferring device 6. It should be noted that the uniformly charged state includes a state where there is neither positive (+) charge nor negative (−) charge i.e. no charge is uniformly applied to the latent image carrier 2 by removing charge from the latent image carrier 2.

Figure 2:
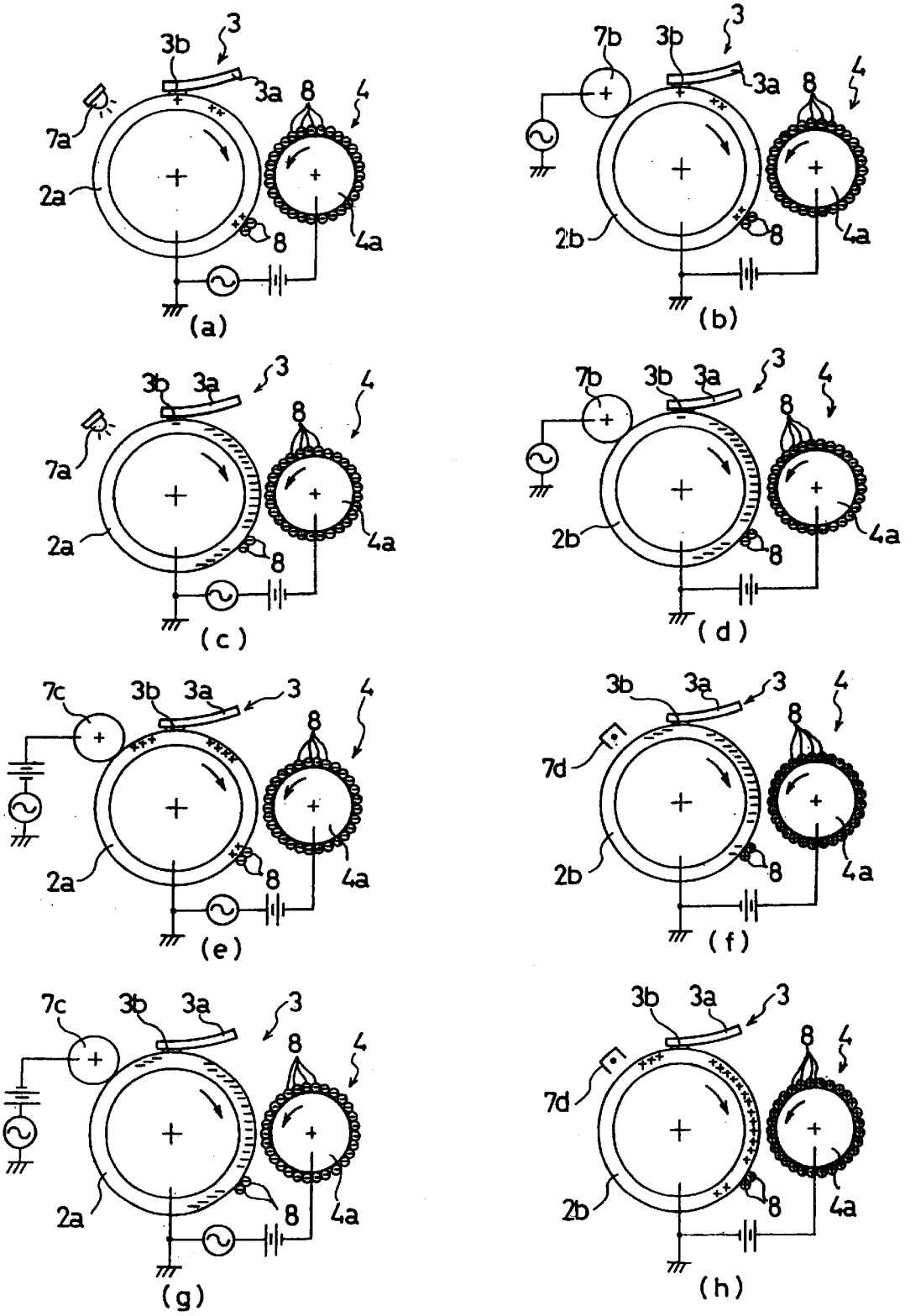
FIG. 2, parts (a)–(h), are views each illustrating an example of the basic process of forming an image in the image forming apparatus of the present invention.

FIGS. 2(*a*)–2(*h*) are views each illustrating an example of the basic process of forming an image in the image forming apparatus 1 of the present invention.

As the basic process of forming an image in the image forming apparatus 1 of the present invention, there are four types as follows: (1) making uniformly charged state by removal of charge—writing by contact application of charge—normal developing; (2) making uniformly charged state by removal of charge—writing by contact application of charge—reversal developing; (3) making uniformly charged state by application of charge—writing by contact removal of charge—normal developing; and (4) making uniformly charged state by application of charge—writing by contact removal of charge—reversal developing.

(1) Making Uniformly Charged State by Removal of Charge—writing by Contact Application of Charge—normal Developing A process illustrated in FIG. 2(*a*) is an example of this image forming process. As shown in FIG. 2(*a*), in this example, a photoreceptor 2*a* is employed as the latent image carrier 2 and a charge removing lump 7*a* is employed as the charge control device 7. The electrodes 3*b* of the writing device 3 are in contact with the photoreceptor 2*a* so that positive (+) charge is mainly transferred (that is, injected) from the writing electrodes 3*b* to image portions of the photoreceptor 2*a*, whereby the image portions of the photoreceptor 2*a* are positively (+) charged. In this way, an electrostatic latent image is written on the photoreceptor 2*a*. In addition, a bias voltage composed of an alternating current superimposed on a direct current of a negative (−) polarity is applied to the developing powder carrier 4*a* such as an image developing roll of the developing device 4, as in conventional ones. Accordingly, the developing powder carrier 4*a* conveys negatively (−) charged developing powder 8 to the photoreceptor 2*a*. It should be noted that a bias voltage composed only of a direct current of a negative (−) polarity may be applied to the developing powder carrier 4*a*.

In the image forming process of this example, the charge removing lump 7*a* removes charge from the surface of the photoreceptor 2*a* to make the surface into the uniformly charged state with nearly 0V (zero volt) and, after that, the image portions of the photoreceptor 2*a* are positively (+) charged by the writing electrodes 3*b* of the writing device 3, thereby writing an electrostatic latent image onto the photoreceptor 2*a*. Then, negatively (−) charged developing powder 8 conveyed by the developing powder carrier 4*a* of the developing device 4 adheres to the positively (+) charged image portions of the photoreceptor 2*a*, thereby normally developing the electrostatic latent image.

A process illustrated in FIG. 2(*b*) is another example of this image forming process. As shown in FIG. 2(*b*), in this example, a dielectric body 2*b* is employed as the latent image carrier 2 and a charge removing roller 7*b* is employed as the charge control device 7. As in conventional ones, a bias voltage composed of a direct current of a negative (−) polarity may be applied to the developing powder carrier 4*a* of the developing device 4. It should be noted that a bias voltage composed of an alternating current superimposed on a direct current of a negative (−) polarity may be applied to the developing powder carrier 4*a*. On the other hand, a bias voltage composed of an alternating current is applied to the charge removing roller 7*b*. Other structures of this example are the same as those of the aforementioned example shown in FIG. 2(*a*).

In the image forming process of this example, the charge removing roller 7*b* is in contact with the dielectric body 2*b* so as to remove charge from the surface of the dielectric body 2*b* to make the surface into the uniformly charged state with nearly 0V (zero volt). The image forming actions after that are the same as those of the aforementioned example shown in FIG. 2(*a*), except that the dielectric body 2*b* is used instead of the photoreceptor 2*a*.

(2) Making Uniformly Charged State by Removal of Charge—writing by Contact Application of Charge—reversal Developing A process shown in FIG. 2(*c*) is an example of this image forming process. As shown in FIG. 2(*c*), in this example, a photoreceptor 2*a* is employed as the latent image carrier 2 and a charge removing lump 7*a* is employed as the charge control device 7 just like the example shown in FIG. 2(*a*). The writing electrodes 3*b* of the writing device 3 are in contact with the photoreceptor 2*a* so that negative (−) charge is mainly transferred (that is, injected) from the writing electrodes 3*b* to non-image portions of the photoreceptor 2*a*, whereby the non-image portions of the photoreceptor 2*a* are negatively (−) charged. Other structures of this example are the same as those of the aforementioned example shown in FIG. 2(*a*).

In the image forming process of this example, the charge removing lump 7*a* removes charge from the surface of the photoreceptor 2*a* to make the surface into the uniformly charged state with nearly 0V (zero volt) and, after that, the non-image portions of the photoreceptor 2*a* are negatively (−) charged by the writing electrodes 3*b* of the writing device 3, thereby writing an electrostatic latent image onto the photoreceptor 2*a*. Then, negatively (−) charged developing powder 8 conveyed by the developing powder carrier 4*a* of the developing device 4 adheres to portions, not negatively (−) charged and having nearly 0V (zero volt), of the photoreceptor 2*a*, thereby reversely developing the electrostatic latent image.

A process illustrated in FIG. 2(*d*) is another example of this image forming process. As shown in FIG. 2(*d*), in this example, a dielectric body 2*b* is employed as the latent image carrier 2 and a charge removing roller 7*b* is employed as the charge control device 7 just like the example shown in FIG. 2(*b*). The writing electrodes of the writing device 3 are arranged in contact with the dielectric body 2*b* to negatively charge non-image portions of the dielectric body 2*b*. Other structures of this example are the same as those of the aforementioned example shown in FIG. 2(*b*).

In the image forming process of this example, the charge removing roller 7*b* is in contact with the dielectric body 2*b* so as to remove charge from the surface of the dielectric body 2*b* to make the surface into the uniformly charged state with nearly 0V (zero volt). The image forming actions after that are the same as those of the aforementioned example shown in FIG. 2(*c*), except that the dielectric body 2*b* is used instead of the photoreceptor 2*a*.

(3) Making Uniformly Charged State by Application of Charge—writing by Contact Removal of Charge—normal Developing A process shown in FIG. 2(*e*) is an example of this image forming process. As shown in FIG. 2(*e*), in this example, a photoreceptor 2*a* is employed as the latent image carrier 2 and a charging roller 7*c* is employed as the charge control device 7. A bias voltage composed of an alternating current superimposed on a direct current of a positive (+) polarity is applied to the charging roller 7*c* so that the charging roller 7*c* uniformly positively charges the surface of the photoreceptor 2*a*. It should be noted that a bias voltage composed only of a direct current of a positive (+) polarity may be applied to the charging roller 7*c*. In addition, the writing electrodes 3*b* of the writing device 3 are in contact with the photoreceptor 2*a* so that positive (+) charge is mainly transferred (that is, extracted) from the non-image portions of the photoreceptor 2*a* to the writing electrodes 3*b*, whereby positive (+) charge is removed from the non-image portions of the photoreceptor 2*a*. Other structures of this example are the same as those of the aforementioned example shown in FIG. 2(*a*).

In the image forming process of this example, the charging roller 7*c* is arranged in contact with the photoreceptor 2*a* to positively (+) charge the surface of the photoreceptor 2*a* to make the surface into the uniformly charged state with a predetermined voltage and, after that, positive (+) charge is removed from the non-image portions of the photoreceptor 2*a* by the writing electrodes 3*b* of the writing device 3, thereby writing an electrostatic latent image onto the photoreceptor 2*a*. Then, negatively (−) charged developing powder 8 conveyed by the developing powder carrier 4*a* of the developing device 4 adheres to the image portions, positively (+) charged, of the photoreceptor 2*a*, thereby normally developing the electrostatic latent image.

A process illustrated in FIG. 2(*f*) is another example of this image forming process. As shown in FIG. 2(*f*), in this example, a dielectric body 2*b* is employed as the latent image carrier 2 and a corona charging device 7*d* is employed as the charge control device 7. A bias voltage composed of a direct current of a negative (−) polarity or a bias voltage composed of an alternating current superimposed on a direct current of a negative (−) polarity is applied to the corona charging device 7*d*, but not illustrated. The writing electrodes of the writing device 3 are arranged in contact with the dielectric body 2*b* to remove negative (−) charge from the non-image portions of the dielectric body 2*b*. Moreover, a bias voltage composed of a direct current of a positive (+) polarity is applied to the developing powder carrier 4*a* so that the developing powder carrier 4*a* conveys positively (+) charged developing powder 8 to the dielectric body 2*b*. It should be noted that a bias voltage composed of an alternating current superimposed on a direct current of a positive (+) polarity may be applied to the developing powder carrier 4*a*. Other structures of this example are the same as those of the aforementioned example shown in FIG. 2(*b*).

In the image forming process of this example, the surface of the dielectric body 2*b* is negatively (−) charged by the corona charging device 7*d* to make the surface of the dielectric body 2*b* into the uniformly charged state with the predetermined voltage and, after that, negative (−) charge is removed from the non-image portions of the dielectric body 2*b* by the writing electrodes 3*b* of the writing device 3, thereby writing an electrostatic latent image on the dielectric body 2*b*. Then, positively (+) charged developing powder 8 conveyed by the developing powder carrier 4*a* of the developing device 4 adheres to the image portions, negatively (−) charged, of the dielectric body 2*b*, thereby normally developing the electrostatic latent image.

(4) Making Uniformly Charged State by Application of Charge—writing by Contact Removal of Charge—reversal Developing A process shown in FIG. 2(*g*) is an example of this image forming process. As shown in FIG. 2(*g*), in this example, a photoreceptor 2*a* is employed as the latent image carrier 2 and a charging roller 7*c* is employed as the charge control device 7. A bias voltage composed of an alternating current superimposed on a direct current of a negative (−) polarity is applied to the charging roller 7*c* so that the charging roller 7*c* uniformly negatively (−) charges the surface of the photoreceptor 2*a*. It should be noted that a bias voltage composed only of a direct current of a negative (−) polarity may be applied to the charging roller 7*c*. The writing electrodes 3*b* of the writing device 3 are in contact with the photoreceptor 2*a* so that negative (−) charge is transferred (that is, extracted) from the image portions of the photoreceptor 2*a* to the writing electrodes 3*b*, whereby negative (−) charge is removed from the image portions of the photoreceptor 2*a*. Other structures of this example are the same as those of the aforementioned example shown in FIG. 2(*a*).

In the image forming process of this example, the charging roller 7*c* is arranged in contact with the photoreceptor 2*a* to negatively charge the surface of the photoreceptor 2*a* to make the surface into the uniformly charged state with a predetermined voltage and, after that, negative (−) charge is removed from the image portions of the photoreceptor 2*a* by the writing electrodes 3*b* of the writing device 3, thereby writing an electrostatic latent image onto the photoreceptor 2*a*. Then, negatively (−) charged developing powder 8 conveyed by the developing powder carrier 4*a* of the developing device 4 adheres to the image portions, not negatively (−) charged, of the photoreceptor 2*a*, thereby reversely developing the electrostatic latent image.

A process illustrated in FIG. 2(*h*) is another example of this image forming process. As shown in FIG. 2(*h*), in this example, a dielectric body 2*b* is employed as the latent image carrier 2 and a corona charging device 7*d* is employed as the charge control device 7. A bias voltage composed of a direct current of a positive (+) polarity or a bias voltage composed of an alternating current superimposed on a direct current of a positive (+) polarity is applied to the corona charging device 7*d*, but not illustrated. Other structures of this example are the same as those of the aforementioned example shown in FIG. 2(*f*).

In the image forming process of this example, the surface of the dielectric body 2*b* is positively (+) charged by the corona charging device 7*d* to Make the surface of the dielectric body 2*b* into the uniformly charged state with the predetermined voltage and, after that, positive (+) charge is removed from the image portions of the dielectric body 2*b* by the writing electrodes 3*b* of the writing device 3, thereby writing an electrostatic latent image onto the dielectric body 2*b*. Then, positively (+) charged developing powder 8 conveyed by the developing powder carrier 4*a* of the developing device 4 adheres to the image portions, not positively charged, of the dielectric body 2*b*, thereby reversely developing the electrostatic latent image.

Figure 3:
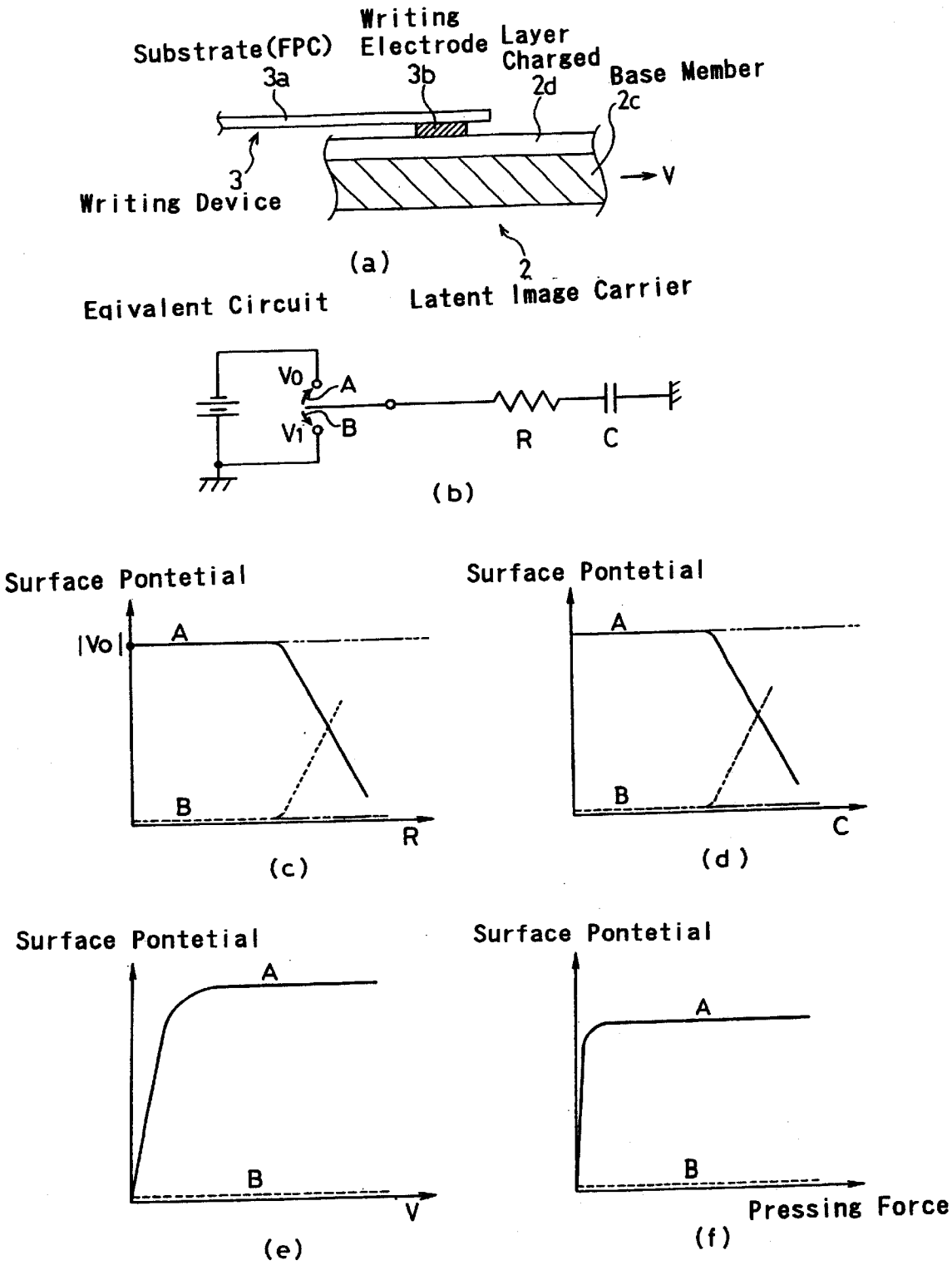
FIG. 3, parts (a)–(f), are views for explaining the principle of writing an electrostatic latent image by writing electrodes of a writing device through application or removal of charge, wherein part (a) is an enlarged view of a portion where a writing electrode is in contact with the latent image carrier, part (b) is a diagram of an electrical equivalent circuit of the contact portion, and parts (c)–(f) are graphs each showing the relation between each parameter and the surface potential of the latent image carrier.

FIGS. 3(*a*)–3(*f*) are views for explaining the principle of writing an electrostatic latent image by the writing electrodes 3*b* of the writing device 3 through application or removal of charge, wherein FIG. 3(*a*) is an enlarged view of a contact portion where a writing electrode 3*b* is in contact with the latent image carrier 2, FIG. 3(*b*) is a diagram of an electrical equivalent circuit of the contact portion, and FIGS. 3(*c*)–3(*f*) are graphs each showing the relation between each parameter and the surface potential of the latent image carrier 2.

As shown in FIG. 3(*a*), the latent image carrier 2 comprises a base member 2*c* which is made of a conductive material such as aluminum and is grounded and an insulating charged layer 2*d* formed on the outer periphery of the base member 2*c*. The writing electrodes 3*b* supported by the flexible substrate 3*a* made of FPC, PET, or the like of the writing device 3 are in contact with the charged layer 2*d* with a predetermined small pressing force and the latent image carrier 2 travels (rotates) at a predetermined speed "v". As the aforementioned small pressing force, 10N or less per 300 mm in width, that is, a linear load of 0.03N/mm or less is preferable for stabilizing the contact between the writing electrodes 3*b* and the latent image carrier 2 and for stabilizing the charge-transfer therebetween. In view of abrasion, it is preferable to achieve the smallest possible linear load while keeping the contact stability.

Either of a predetermined high voltage $V_0$ and a predetermined low voltage $V_1$, is selectively impressed to the writing electrodes 3*b* through the substrate 3*a* (as mentioned, since there are positive and negative charges, the high voltage is a voltage having a high absolute value and the low voltage is a voltage of the same polarity as the high voltage and having a low absolute value or 0V (zero volt). In the description of the present invention in this specification, the low voltage is a ground voltage. In the following description, therefore, the high voltage $V_0$ is referred to as the predetermined voltage $V_0$ and the low voltage $V_1$ is referred to as the ground voltage $V_1$. It should be understood that the high voltage $V_1$ is 0V (zero volt.)

That is, the contact portion (nip) between each writing electrode 3*b* and the latent image carrier 2 is provided with an electrical equivalent circuit shown in FIG. 3(*b*). In FIG. 3(*b*), "R" designates the resistance of the writing electrode 3*b* and "C" designates the capacity of the latent image carrier 2. The resistance R of the writing electrode 3*b* is selectively switched to be connected to the A side of the predetermined voltage $V_0$ of a negative (–) polarity or to the B side of the ground voltage $V_1$.

FIG. 3(*c*) shows the relation between the resistance R of the writing electrode 3*b* and the surface potential of the latent image carrier 2. The aforementioned relation when the writing electrode 3*b* is connected to the A side in the electrical equivalent circuit to impress the predetermined voltage $V_0$ of a negative (–) polarity to the writing electrode 3*b* is represented by a solid line in FIG. 3(*c*). As shown by the solid line in FIG. 3(*c*), the surface potential of the latent image carrier 2 is constant at the predetermined voltage $V_0$ in a region where the resistance R of the writing electrode 3*b* is small, and the absolute value of the surface potential of the latent image carrier 2 decreases in a region where the resistance R of the writing electrode 3*b* is greater than a predetermined value. On the other hand the relation between the resistance R of the writing electrode 3*b* and the surface potential of the latent image carrier 2 when the writing electrode 3*b* is connected to the B side to ground the electrode 3*b* is represented by a dotted line in FIG. 3(*c*). As shown by the dotted line in FIG. 3(*c*), the surface potential of the latent image carrier 2 is constant at substantially the ground voltage $V_1$ in a region where the resistance R of the writing electrode 3*b* is small, and the absolute value of the surface potential of the latent image carrier 2 increases in a region where the resistance R of the writing electrode 3*b* is greater than the predetermined value.

Figure 4:
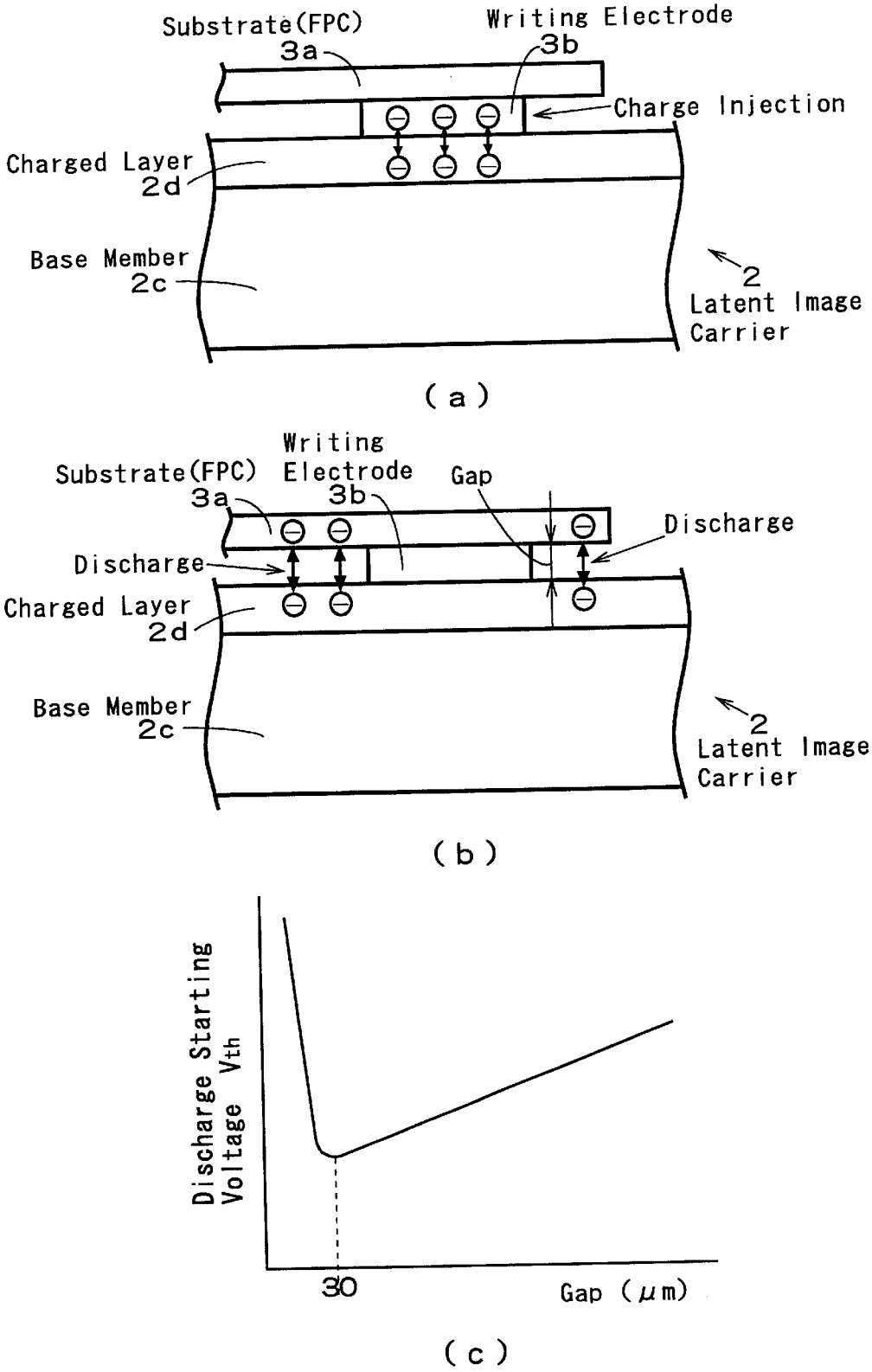
FIG. 4, parts (a)–(c), are views for explaining the application or removal of charge relative to the latent image carrier, wherein FIG. 4(*a*) is a view for explaining the application or removal of charge relative to the latent image carrier via the contact charge-transfer, FIG. 4(*b*) is a view for explaining the application or removal of charge relative to the latent image carrier via the discharging, and part (c) is a graph for explaining Paschen's law.

In the region where the resistance R of the writing electrode 3*b* is small and the surface potential of the latent image carrier 2 is constant at the predetermined voltage $V_0$ or constant at the ground voltage $V_1$, negative (–) charge directly moves from a lower voltage side to a higher voltage side, that is, the contact charge-transfer is conducted between the writing electrode 3*b* being in contact with the latent image carrier 2 and the charged layer 2*d* of the latent image carrier 2, as shown in FIG. 4(*a*). This means that charge is applied to or removed from the latent image carrier 2 via the contact charge-transfer. In the region where the resistance R of the writing electrode 3*b* is great and the surface potential of the latent image carrier 2 starts to vary, the application or removal of charge relative to the latent image carrier 2 via the contact charge-transfer is gradually reduced and charge-transfer by discharge (hereinafter, sometimes referred to as "non-contact charge-transfer") occurs between the substrate 3*a* and the latent image carrier 2 as shown in FIG. 4(*b*) as the resistance R of the writing electrode 3*b* is increased.

The non-contact charge-transfer between the substrate 3*a* and the base member 2*c* of the latent image carrier 2 occurs when the absolute value of the voltage (the predetermined voltage $V_0$) between the substrate 3*a* and the latent image carrier 2 becomes higher than a discharge starting voltage $V_{th}$. The relation between the gap, between the substrate 3*a* and the latent image carrier 2, and the discharge starting voltage $V_{th}$ is just as shown in FIG. 4(*c*), according to Paschen's law. That is, the discharge starting voltage $V_{th}$ is the lowest when the gap is about 30 $\mu$m, so the discharge starting voltage $V_{th}$ should be high when the gap is either larger or smaller than about 30 $\mu$m, making the occurrence of discharge difficult. Even via the discharge i.e. the non-contact charge-transfer, charge can be applied to or removed from the surface of the latent image carrier 2. However, when the resistance R of the writing electrode 3*b* is in this region, the application or removal of charge relative to the latent image carrier 2 via the contact charge-transfer is greater while the application or removal of charge relative to the latent image carrier 2 via the non-contact charge-transfer is smaller. This means that the application or removal of charge relative to the latent image carrier 2 is dominated by the application or removal of charge via the contact charge-transfer. By the application or removal of charge via the contact charge-transfer, the surface potential of the latent image carrier 2 becomes to the predetermined voltage $V_0$ to be impressed to the writing electrode 3d or the ground voltage $V_1$. In case of the application of charge via the contact charge-transfer, the predetermined voltage $V_0$ to be supplied to the writing electrode 3*b* is preferably set to a voltage equal to or less than the discharge starting voltage $V_{th}$ at which the discharge occurs between the writing electrode 3*b* and the latent image carrier 2.

When the resistance R of the writing electrode 3*b* is greater than the region, the application or removal of charge relative to the latent image carrier 2 via the contact charge-transfer is smaller while the application or removal of charge relative to the latent image carrier 2 via the non-contact charge-transfer is greater than that via the contact charge-transfer. The application or removal of charge relative to the latent image carrier 2 gradually becomes dominated by the application or removal of charge via the non-contact charge-transfer. That is, as the resistance R of the writing electrode 3*b* becomes greater, the application or removal of charge relative to the surface of the latent image carrier 2 is performed mainly via the non-contact charge-transfer and rarely via the contact charge-transfer. By the application or removal of charge via the non-contact charge-transfer, the surface potential of the latent image carrier 2 becomes to a voltage obtained by subtracting the discharge starting voltage $V_{th}$ from the predetermined voltage $V_0$ to be impressed to the writing electrode 3*d* or the ground voltage $V_1$. It should be noted that the same is true when the predetermined voltage $V_0$ is of a positive (+) polarity.

Therefore, the application or removal of charge relative to the latent image carrier 2 via the contact charge-transfer can be achieved by satisfying a condition that the resistance R of the electrode 3*b* is set in such a small range as to allow the surface potential of the latent image carrier 2 to be constant at the predetermined voltage $|V_0|$ (this is an absolute value because voltages of opposite (±) polarities are available) or constant at the ground voltage $V_1$ and by controlling the voltage to be impressed to the writing electrode 3*b* to be switched between the predetermined voltage $V_0$ and the ground $V_1$.

FIG. 3(*d*) shows the relation between the capacity C of the latent image carrier 2 and the surface potential of the latent image carrier 2. The aforementioned relation when the writing electrode 3*b* is connected to the A side to impress the predetermined voltage $V_0$ of a negative (−) polarity to the writing electrode 3*b* is represented by a solid line in FIG. 3(*d*). As shown by the solid line in FIG. 3(*d*), the surface potential of the latent image carrier 2 is constant at the predetermined voltage $V_0$ in a region where the capacity C of the latent image carrier 2 is small, and the absolute value of the surface potential of the latent image carrier 2 decreases in a region where the capacity C of the latent image carrier 2 is larger than a predetermined value. On the other hand, the relation between the capacity C of the latent image carrier 2 and the surface potential of the latent image carrier 2 when the writing electrode 3*b* is connected to the B side to ground the writing electrode 3*b* is represented by a dotted line in FIG. 3(*d*). As shown by the dotted line in FIG. 3(*d*), the surface potential of the latent image carrier 2 is constant at substantially the ground voltage $V_1$ in a region where the capacity C of the latent image carrier 2 is small, and the absolute value of the surface potential of the latent image carrier 2 increases in a region where the capacity C of the latent image carrier 2 is larger than a predetermined value.

In the region where the capacity C of the latent image carrier 2 is small and the surface potential of the latent image carrier 2 is constant at the predetermined voltage $V_0$ or constant at the ground voltage $V_1$, negative (−) charge is directly transferred between the writing electrode 3*b* being in contact with the latent image carrier 2 and the charged layer 2*d* of the latent image carrier 2. That is, charge is applied to or removed from the latent image carrier 2 via the contact charge-transfer. In the region where the capacity C of the latent image carrier 2 is large and the surface potential of the latent image carrier 2 starts to vary, the application or removal of charge relative to the latent image carrier 2 via the contact charge-transfer is gradually reduced and non-contact charge-transfer is started between the substrate 3*a* and the base member 2*c* of the latent image carrier 2 as shown in FIG. 4(*b*) as the capacity C of the latent image carrier 2 is increased. Even via the non-contact charge-transfer, charge can be applied to or removed from the surface of the latent image carrier 2. However, when the capacity C of the latent image carrier 2 is in this region, the application or removal of charge relative to the latent image carrier 2 via the contact charge-transfer is greater while the application or removal of charge relative to the latent image carrier 2 via the non-contact charge-transfer is smaller. This means that the application or removal of charge relative to the latent image carrier 2 is dominated by the application or removal of charge via the contact charge-transfer. By the application or removal of charge via the contact charge-transfer, the surface potential of the latent image carrier 2 becomes to the predetermined voltage $V_0$ to be impressed to the writing electrode 3*d* or the ground voltage $V_1$.

When the capacity C of the latent image carrier 2 is greater than the region, there is now little contact charge-transfer between the writing electrode 3*b* and the charged layer 2*d* of the latent image carrier 2. This means that little or no charge is applied to or removed from the latent image carrier 2 via the contact charge-transfer. It should be noted that the same is true when the predetermined voltage $V_0$ is of a positive (+) polarity.

Therefore, the application or removal of charge relative to the latent image carrier 2 via the contact charge-transfer can be achieved by satisfying a condition that capacity C of the latent image carrier 2 is set in such a small range as to allow the surface potential of the latent image carrier 2 to be constant at the predetermined voltage $|V_0|$ (this is an absolute value because voltages of opposite (±) polarities are available) or constant at the ground voltage $V_1$ and by controlling the voltage to be impressed to the writing electrode 3*b* to be switched between the predetermined voltage $V_0$ and the ground $V_1$.

FIG. 3(*e*) shows the relation between the velocity (peripheral velocity) v of the latent image carrier 2 and the surface potential of the latent image carrier 2. The aforementioned relation when the writing electrode 3*b* is connected to the A side to impress the predetermined voltage $V_0$ of a negative (−) polarity to the writing electrode 3*b* is represented by a solid line in FIG. 3(*e*). As shown by the solid line in FIG. 3(*e*), the surface potential of the latent image carrier 2 increases as the velocity v increases in a region where the velocity v of the latent image carrier 2 is relatively low, and the absolute value of the surface potential of the latent image carrier 2 is constant in a region where the velocity v of the latent image carrier 2 is higher than a predetermined value. The reason of increase in the surface potential of the latent image carrier 2 with the increase in the velocity v of the latent image carrier 2 is considered as that the contact charge-transfer to the latent image carrier 2 is facilitated due to friction between the writing electrode 3*b* and the latent image carrier 2. The velocity v of the latent image carrier 2 has an extent above which the facilitation of the contact charge-transfer due to friction is no longer increased and becomes substantially constant. On the other hand, the relation between the velocity v of the latent image carrier 2 and the surface potential of the latent image carrier 2 when the writing electrode 3*b* is connected to the B side to ground the writing electrode 3*b* is represented by a dotted line in FIG. 3(*e*). As shown by the dotted line in FIG. 3(*e*), the surface potential of the latent image carrier 2 is constant at the ground voltage $V_1$ regardless of the velocity v of the latent image carrier 2. It should be noted that the same is true when the predetermined voltage $V_0$ is of a positive (+) polarity.

FIG. 3(*f*) shows the relation between the pressing force applied to the latent image carrier 2 by the writing electrode 3*b* (hereinafter, just referred to as "the pressure of the writing electrode 3*b*") and the surface potential of the latent image carrier 2. The aforementioned relation when the writing electrode 3*b* is connected to the A side to impress the predetermined voltage $V_0$ of a negative (−) polarity to the writing electrode 3*b* is represented by a solid line in FIG. 3(*f*). As shown by the solid line in FIG. 3(*f*), the surface potential of the latent image carrier 2 relatively rapidly increases as the pressure of the writing electrode 3*b* increases in a region where the pressure of the writing electrode 3*b* is very low, and the absolute value of the surface potential of the latent image carrier 2 is constant in a region where the pressure of the writing electrode 3*b* is higher than a predetermined value. The reason of the rapid increase in the surface potential of the latent image carrier 2 with the increase in the pressure of the writing electrode 3*b* is considered as that the contact between the writing electrode 3*b* and the latent image carrier 2 is further ensured by the increase in the pressure of the writing electrode 3*b* and the latent image carrier 2. The pressure of the writing electrode 3*b* has an extent above which the contact certainty between the writing electrode 3*b* and the latent image carrier 2 is no longer increased and becomes substantially constant. On the other hand, the relation between the pressure of the writing electrode 3*b* and the surface potential of the latent image carrier 2 when the writing electrode 3*b* is connected to the B side to ground the writing electrode 3*b* is represented by a dotted line in FIG. 3(*f*). As shown by the dotted line in FIG. 3(*f*), the surface potential of the latent image carrier 2 is constant at the ground voltage $V_1$ regardless of the pressure of the writing electrode 3*b*. It should be noted that the same is true when the predetermined voltage $V_0$ is of a positive (+) polarity.

Therefore, the application or removal of charge relative to the latent image carrier 2 via the contact charge-transfer can be securely and easily achieved by satisfying conditions that the resistance R of the writing electrode 3*b* and the capacity C of the latent image carrier 2 are set in such a manner as to allow the surface potential of the latent image carrier 2 to be constant at the predetermined voltage and that the velocity v of the latent image carrier and the pressure of the writing electrode 3*b* are set in such a manner as to allow the surface potential of the latent image carrier 2 to be constant at the predetermined voltage, and by controlling the voltage to be impressed to the writing electrode 3*b* to be switched between the predetermined voltage $V_0$ and the ground voltage $V_1$.

Though the predetermined voltage $V_0$ to be impressed to the writing electrode 3*b* is a direct current voltage in the aforementioned embodiment, an alternating current voltage may be superimposed on a direct current voltage. When an alternating current voltage is superimposed, it is preferable that a DC component is set to be a voltage to be impressed to the latent image carrier 2, the amplitude of AC component is set to be twice or more as large as the discharge starting voltage $V_{th}$, and the frequency of AC component is set to be higher than the frequency in rotation of the latent image carrier 2 by about 500–1,000 times (for example, assuming that the diameter of the latent image carrier 2 is 30ϕ and the peripheral velocity of the latent image carrier 2 is 180 mm/sec, the frequency in rotation of the latent image carrier 2 is 2 Hz so that the frequency of AC component is 1,000–2,000 Hz.).

Figure 5:
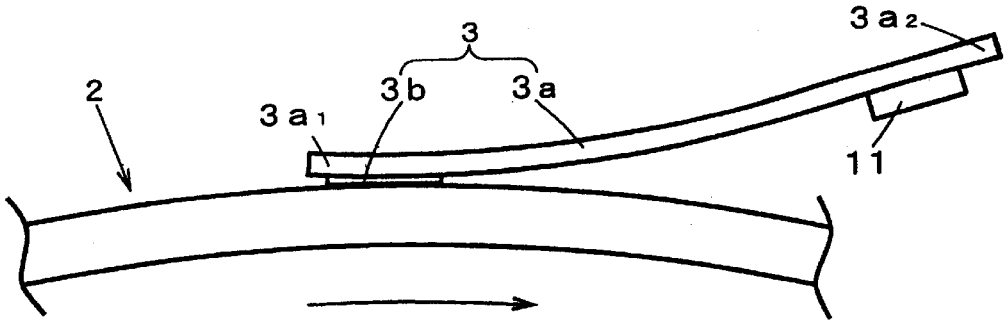
FIG. 5 is a schematic illustration showing an example of the writing device, as seen in an axial direction of the latent image carrier.

Description will now be made as regard to the flexible substrate 3*a* supporting the writing electrodes 3*b* of the writing device 3. FIG. 5 is a schematic illustration showing an example of the writing device 3, as seen in an axial direction of the latent image carrier 2. As mentioned, the substrate 3*a* is made of a flexible material being relatively soft and elastic such as a FPC. The substrate 3*a* has a plurality of writing electrodes 3*b* fixed at its end $3a_1$ as shown in FIG. 5. The writing electrodes 3*b* are arranged in a row extending in the axial direction (main scanning direction) of the latent image carrier 2 as will be described later and the substrate 3*a* is accordingly formed in a rectangular plate shape having a length, along the axial direction of the latent image carrier 2, which is substantially the same as the axial length of the charged layer 2*d* of the latent image carrier 2. The substrate 3*a* is fixed by a suitable fixing member at an end $3a_2$ opposite to the end $3a_1$ where the writing electrodes 3*b* are fixed. The substrate 3*a* is disposed to extend from the right side in FIG. 5 to oppose the rotational direction (indicated by an arrow: the clockwise direction) of the latent image carrier 2. It should be noted that the substrate 3*a* may be disposed to extend from the left side in FIG. 5 in the same direction as the rotational direction of the latent image carrier 2.

In this state, the substrate 3*a* is elastically slightly deflected to produce weak elastic restoring force. By this elastic restoring force, the writing electrodes 3*b* are lightly pressed against and in contact with the latent image carrier 2 with a small pressing force. The fact that the pressing force of the writing electrodes 3*b* onto the latent image carrier 2 is small can suppress the wearing of the charged layer 2*d* of the latent image carrier 2 due to the writing electrodes 3*b*, thus improving the durability. The fact that the writing electrodes 3*b* are kept in contact with the charged layer 2*d* by the elastic force of the substrate 3*a* achieves stable contact of the writing electrodes 3*b* to the charged layer 2*d*. The substrate 3*a* has drivers 11 fixed to the end $3a_2$ for controlling the operation of the writing electrodes 3*b*.

In case where the substrate 3*a* is disposed to oppose the rotational direction of the latent image carrier 2 as shown in FIG. 5, the substrate 3*a* can remove foreign matters adhering to the latent image carrier 2, that is, the writing device 3 is provided with a cleaning characteristic. In case where the substrate 3*a* is disposed to extent in the same direction of the rotational direction of the latent image carrier 2, foreign matters adhering to the latent image carrier 2 are allowed to pass between the substrate 3*a* and the latent image carrier 2.

Figure 6:
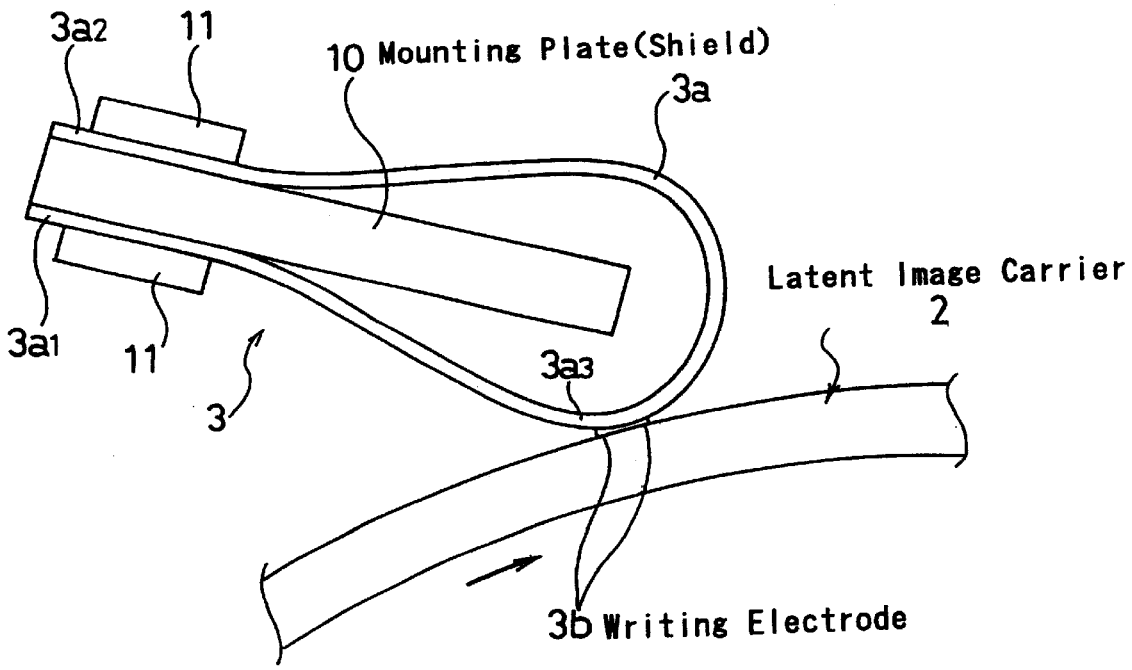
FIG. 6 is a schematic illustration showing another example of the writing device, as seen in an axial direction of the latent image carrier.

FIG. 6 is a schematic illustration showing another example of the writing device 3, as seen in an axial direction of the latent image carrier 2. In the former example, the rectangular substrate 3*a* is fixed at its end $3a_2$ and is thus set to be elastically slightly deflected. In this example, however, a rectangular substrate 3*a* which is made of the same material as the substrate 3*a* of the former example is bent at its center of a direction perpendicular to the axial direction of the latent image carrier 2 into a hair pin curve with a curve top extending along a line of the axial direction of the latent image carrier 2 and the both ends $3a_1$, $3a_2$ of the substrate 3*a* are fixed by a suitable fixing member. In this case, a conductive mounting plate (shield) 10 is interposed between the both ends $3a_1$ and $3a_2$ of the substrate 3*a* for preventing the crosstalk between two sections of the substrate 3*a* about the curve top, i.e. the upper and lower sections in FIG. 6.

Also in this example, the length of the substrate 3*a* in the axial direction of the latent image carrier 2 is set substantially the same as the axial length of the charged layer 2*d* of the latent image carrier 2 and the substrate 3*a* is provided at a predetermined location of a hair pin curve portion (a curved portion) $3a_3$ with a plurality of writing electrodes 3*b* arranged in a row or rows extending in the axial direction of the latent image carrier 2. In a state where the both ends $3a_1$, $3a_2$ of the substrate 3*a* are fixed as shown in FIG. 6, the hair pin curve portion $3a_3$ of the substrate 3*a* is elastically slightly deflected so that the writing electrodes 3*b* are lightly pressed against and in contact with the latent image carrier 2 by the weak elastic restoring force of the hair pin curve portion $3a_3$ of the substrate 3*a*. In the writing device 3 of this example, the substrate 3*a* is supported by the both ends $3a_1$, $3a_2$, thus allowing the writing electrodes 3*b* to be further securely and stably kept in contact with the latent image carrier 2. Though drivers 11 for the electrodes 3*b* fixed to the both ends $3a_1$, $3a_2$ of the substrate 3*a*, respectively are shown in FIG. 6, this arrangement corresponds to an array pattern of electrodes shown in FIG. 9 as will be described later.

Figure 7A:
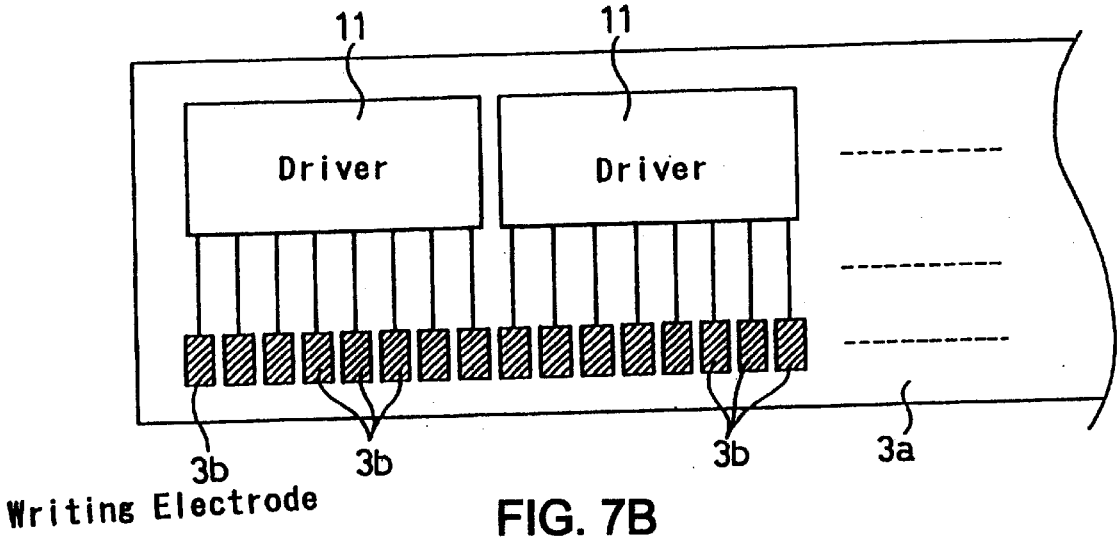
FIG. 7, parts (a)–(c), show array patterns for arranging a plurality of writing electrodes in the axial direction of the latent image carrier, wherein part (a) is a view showing the simplest array pattern for writing electrodes and parts (b)–(c) are views showing array patterns for writing electrodes which achieve to solve problems of the array pattern shown in part (a)
Figure 7B:
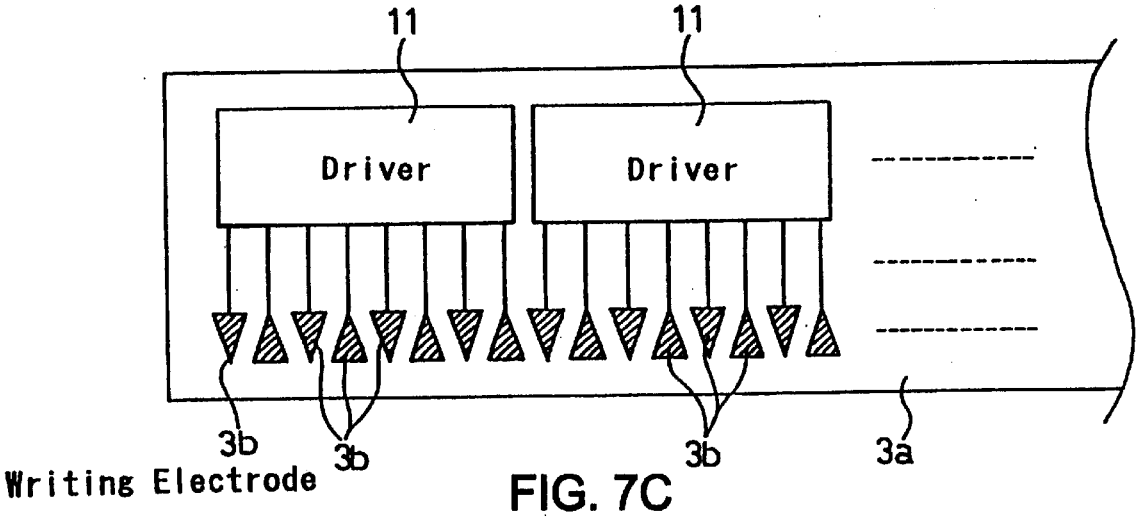
Figure 7C:
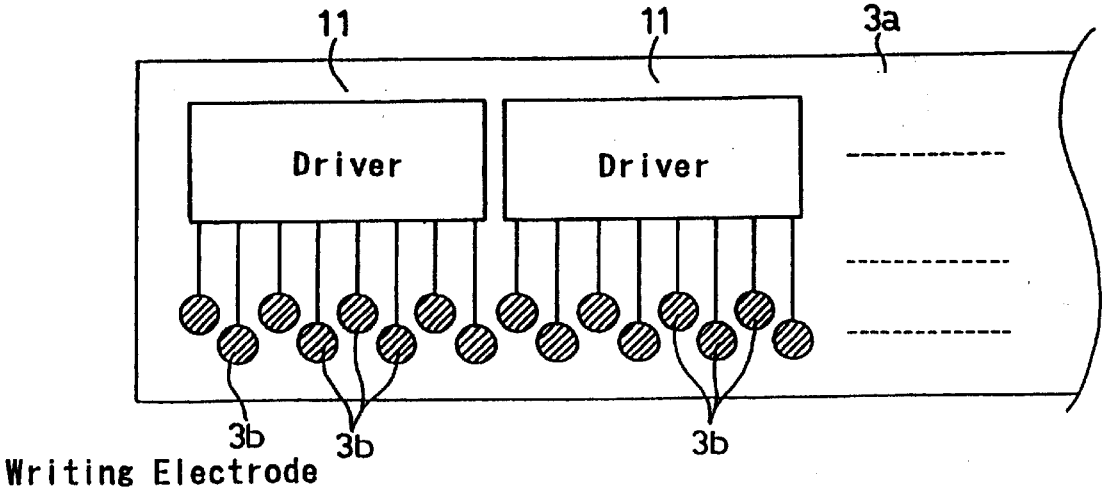

FIGS. 7(*a*)–7(*c*) show array patterns for arranging a plurality of writing electrodes 3*b* in the axial direction of the latent image carrier 2 wherein FIG. 7(*a*) is a view showing the simplest array pattern for writing electrodes and FIGS. 7(*b*) and 7(*c*) are views showing array patterns for writing electrodes which achieve to solve problems of the array pattern shown in FIG. 7(*a*).

In the simplest array pattern for the writing electrodes 3*b*, as shown in FIG. 7(*a*), a plurality of rectangular writing electrodes 3*b* are aligned in a row extending in the axial direction of the latent image carrier 2. In this case, among the writing electrodes 3*b*, a predetermined number (eight in the illustrated example) of writing electrodes 3*b* are connected to and thus united by a driver 11 which controls the corresponding electrodes 3*b* by switching the supply voltage between the predetermined voltage $V_0$ or the ground voltage $V_1$. Plural units of writing electrodes 3*b* are aligned in the same row extending in the axial direction of the latent image carrier 2.

However, when the rectangular electrodes 3*b* are simply aligned in one row extending in the axial direction of the latent image carrier 2 just like this pattern, there should be clearances between adjacent electrodes 3*b*. Portions of the surface of the latent image carrier 2 corresponding to the clearances can not be subjected to the application or removal of charge. Therefore, in the array pattern for the writing electrodes 3*b* shown in FIG. 7(*b*), the writing electrodes 3*b* are each formed in triangle and are alternately arranged in such a manner that the orientations of the adjacent electrodes 3*b* are opposite to each other (that is, one is in the orthographic position while the other one is in the inverted position). In this case, the electrodes are arranged such that ends of the triangle bases of adjacent electrodes which are opposed to each other are overlapped with each other in a direction perpendicular to the axial direction of the latent image carrier 2 (the feeding direction: the rotational direction of the latent image carrier 2). The design of partially overlapping adjacent writing electrodes 3*b* in the direction perpendicular to the axial direction of the latent image carrier 2 can eliminate such portions in the surface of the latent image carrier 2 that are not subjected to the application or removal of charge, thereby achieving uniform application or removal of charge relative to the entire surface of the latent image carrier 2. Also in this example, plural units are each formed by connecting a predetermined number of electrodes 3*b* to one driver 11 and are aligned in one row. It should be noted that, instead of triangle, each electrode 3*b* may be formed in any configuration that allows adjacent electrodes to be partially overlapped with each other in the direction perpendicular to the axial direction of the latent image carrier 2, for example, trapezoid, parallelogram, and a configuration having at least one angled side among sides opposed to adjacent electrodes 3*b*. Also in this example, plural units are each formed by connecting a predetermined number of electrodes 3*b* to one driver 11 and are aligned in one row in the same manner as the pattern shown in FIG. 7(*a*), and the respective drivers 11 are disposed on the same side of the corresponding electrodes 3*b*.

Figure 8:
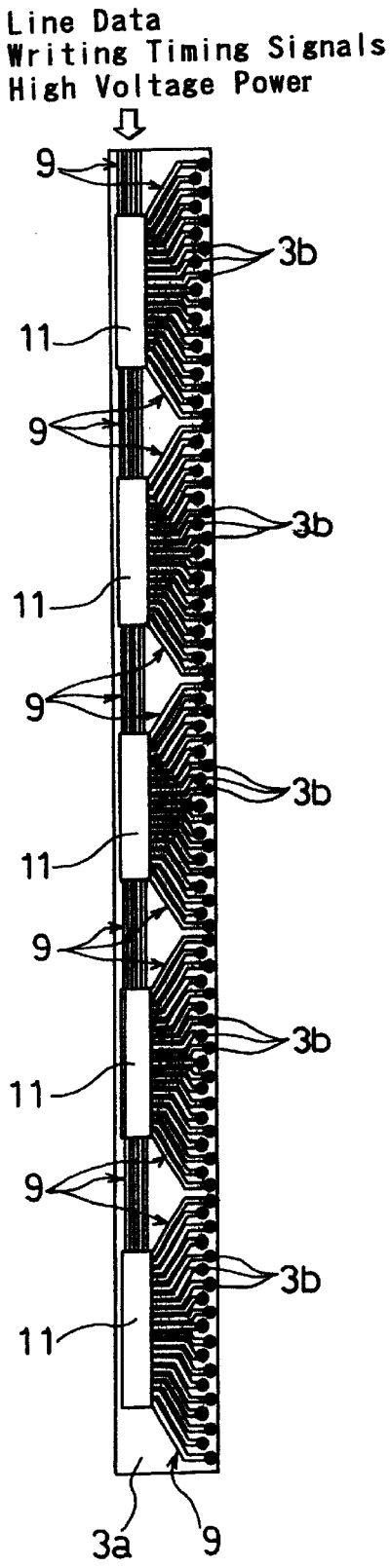
FIG. 8 is a view for illustrating the array pattern for the writing electrodes and the wiring pattern for drivers.
Figure 11:
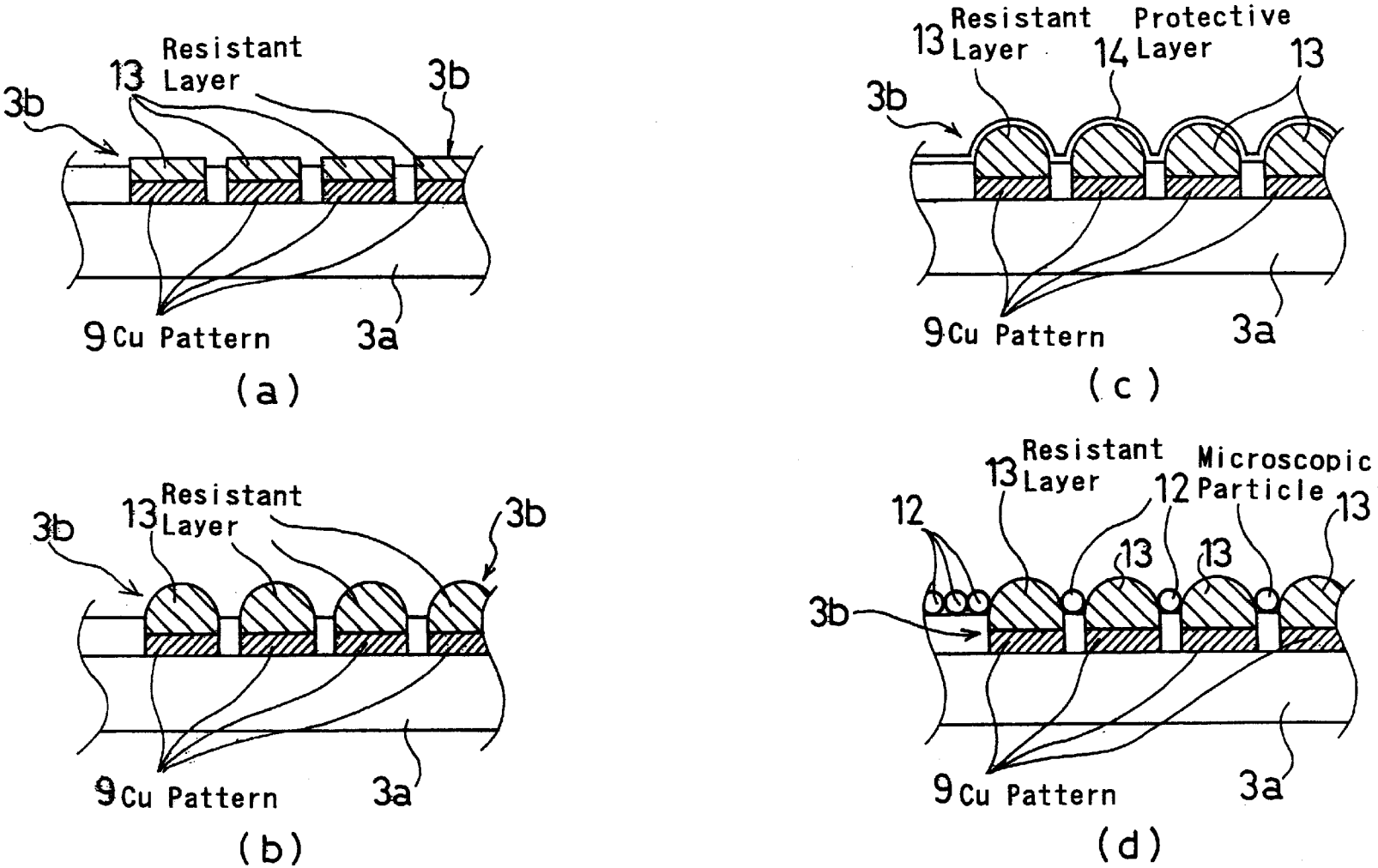
FIG. 11, parts (a)–(d), are sectional views each showing an example of the writing electrodes of the writing device.

In the array pattern for the writing electrodes 3*b* shown in FIG. 7(*c*), the writing electrodes 3*b* are each formed in circle and are aligned in two parallel rows (first and second rows) extending in the axial direction of the latent image carrier 2 in such a manner that the writing electrodes 3*d* are arranged in a zigzag fashion. In this case, the electrodes are arranged such that electrodes which are in different rows but adjacent to each other are partially overlapped with each other in the direction perpendicular to the axial direction of the latent image carrier 2. Also this array pattern can eliminate such portions in the surface of the latent image carrier 2 that are not subjected to the application or removal of charge, thereby achieving uniform application or removal of charge relative to the entire surface of the latent image carrier 2. In this example, plural units are each formed of a predetermined number of electrodes 3*b* some of which are in the first row and the other are in the second row by connecting these electrodes 3*b* to one driver 11 and are aligned extending in the axial direction of the latent image carrier 2. The respective drivers 11 are disposed on the same side of the corresponding electrodes 3*b*. As shown in FIG. 8, the respective drivers 11 are electrically connected by conductive patterns (Cu patterns) 9 made of copper (Cu) foil which is formed on the substrate and each line of which is formed into a thin plate-like shape having a rectangular section (sections are shown in FIGS. 11(*a*)–11(*d*) as will be described later). In the same manner, the drivers 11 are electrically connected to the corresponding electrodes 3*b* by the conductive patterns 9. The conductive patterns 9 can be formed by a conventional known pattern forming method such as etching. By way of the conductive patterns 9, line data, writing timing signals, and high voltage power are supplied to the respective drivers 11 from the upper side in FIG. 8.

Figure 9:
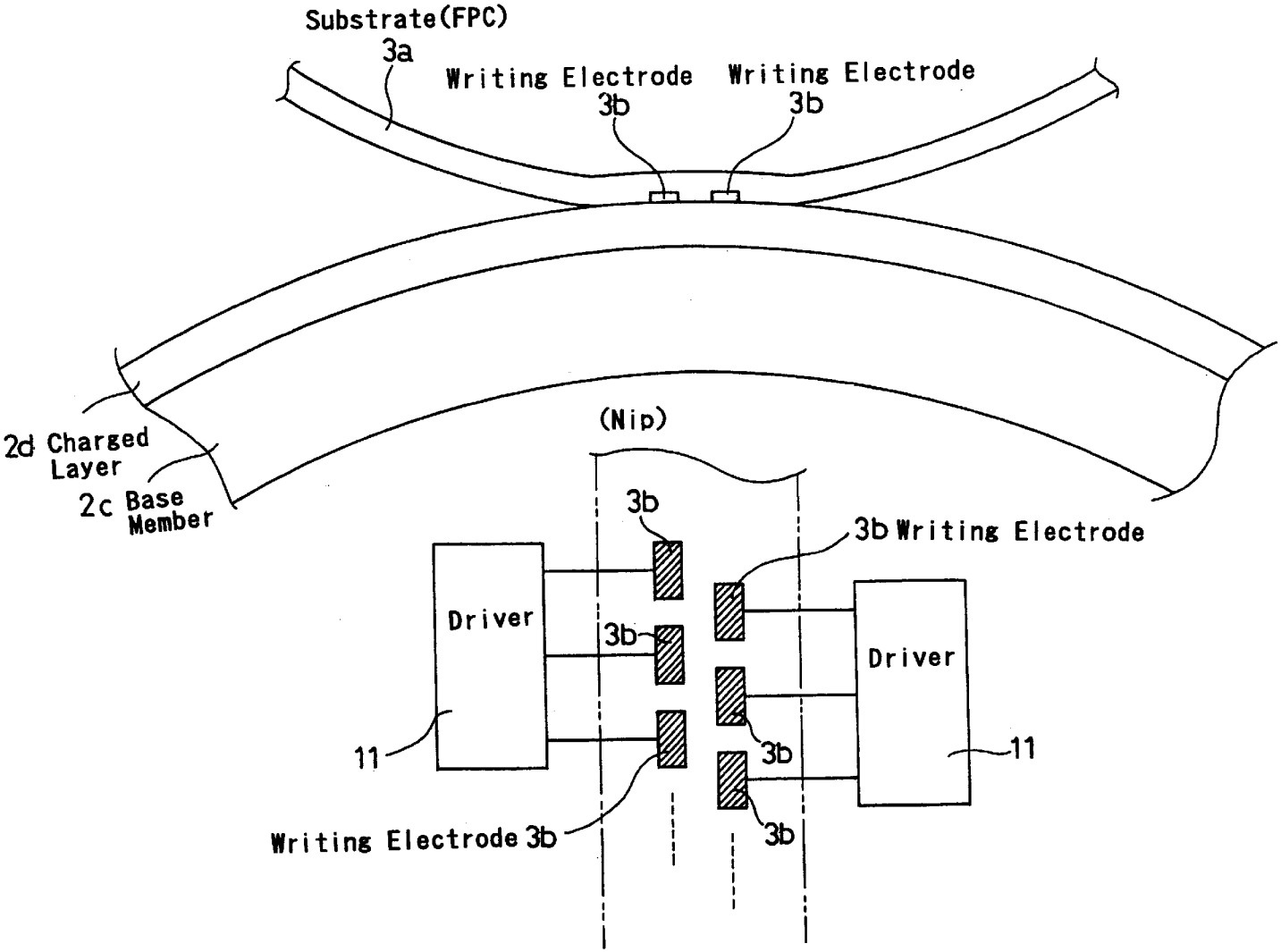
FIG. 9 is a view showing still another example of the array pattern for the writing electrodes.

FIG. 9 is a view showing still another example of the array pattern for the writing electrodes 3*b*.

As shown in FIG. 9, in this array pattern for the writing patterns 3*b*, the writing electrodes 3*b* are each formed in rectangle. In the same manner as the example shown in FIG. 7(*c*), the writing electrodes 3*b* are aligned in two parallel rows (first and second rows) extending in the axial direction of the latent image carrier 2 in such a manner that the writing electrodes 3*d* are arranged in a zigzag fashion and arranged such that electrodes which are in different rows but adjacent to each other are partially overlapped with each other in the direction perpendicular to the axial direction of the latent image carrier 2. Also this array pattern can eliminate such portions in the surface of the latent image carrier 2 that are not subjected to the application or removal of charge, thereby achieving uniform application or removal of charge relative to the entire surface of the latent image carrier 2. In this example, a predetermined number of electrodes 3*b* in the first row are connected to and united by one driver 11 and a predetermined number of electrodes 3*b* in the second row are connected to and united by another driver 11. For each row, plural units are formed and aligned. The drivers 11 for the electrodes 3*b* in the first row are disposed on the opposite side of the drivers 11 for the electrodes 3*b* in the second row such that these electrodes 3*b* are located therebetween and, as shown in FIG. 6, the opposed drivers 11 are fixed to the both ends $3a_1$, $3a_2$, respectively, of the substrate 3*a* which is bent in a hair pin curve.

Figure 10:
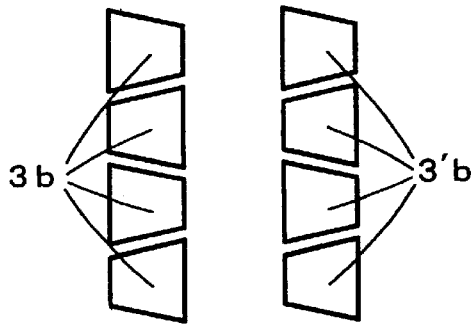
FIG. 10, parts (a)–(d), are views showing still another examples of the array pattern for the writing electrodes.
Figure 10:
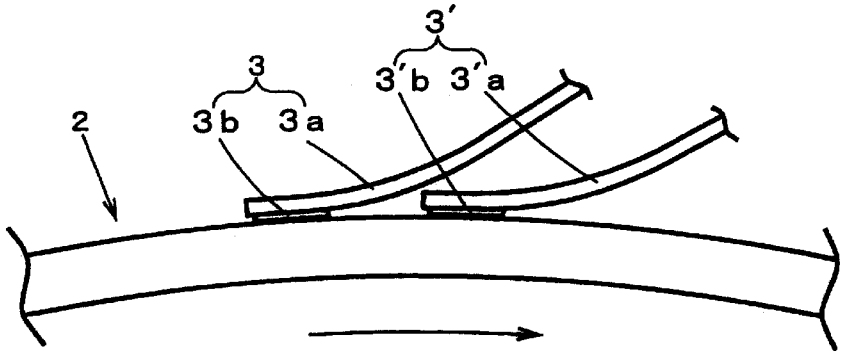
Figure 10:
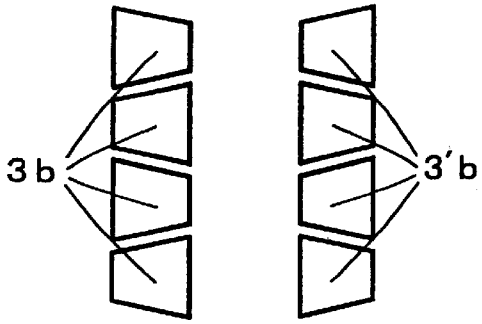
Figure 10:
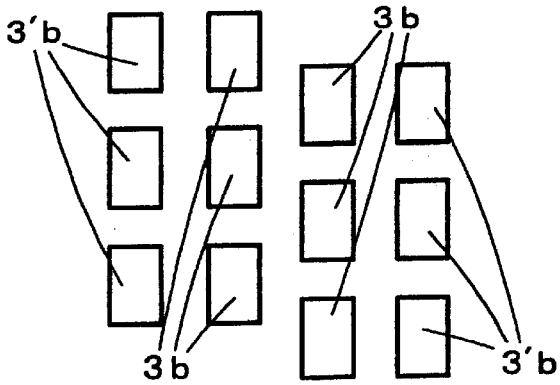

FIGS. 10(*a*)–10(*d*) are views showing still another examples of the array pattern for the writing electrodes 3*b*.

In any of the array patterns for the writing electrodes 3*b* of the aforementioned examples shown in FIG. 7(*c*) and FIG. 9, the writing electrodes 3*b* are aligned in two parallel rows extending in the axial direction of the latent image carrier 2 in such a manner that the writing electrodes 3*d* are arranged in a zigzag fashion. In the array pattern for the writing electrodes 3*b* of an example shown in FIGS. 10(*a*) and 10(*b*), however, writing electrodes 3*b* are aligned in two rows (first and second rows) which are completely identical to each other and spaced at a predetermined distance in the direction perpendicular to the axial direction of the latent image carrier 2, wherein the first row consists of writing electrodes 3*b* which are, for example, trapezoidal and the second row consists of writing electrodes 3'b corresponding to the writing electrodes 3*b* of the first row. That is, two identical writing electrodes 3*b*, 3'*b* are arranged in a line along the direction perpendicular to the axial direction of the latent image carrier 2. This design achieves further secured and stable application of charge relative to the charged layer 2*d* of the latent image carrier 2. It should be noted that, in the same manner as the example shown in FIG. 7(*b*), opposed oblique sides of adjacent trapezoidal electrodes 3*b* or 3'*b* in the same row are partially overlapped with each other in the direction perpendicular to the axial direction of the latent image carrier 2.

In the array pattern of an example shown in FIG. 10(*c*), the orientations of trapezoids of the writing electrodes 3*b* in the first row are opposite to those of the writing electrodes 3'*b* in the second row in the example shown in FIG. 10(*b*). The array pattern of an example shown in FIG. 10(*d*) is similar to that shown in FIG. 9, but additional writing electrodes 3'*b* are aligned in two additional rows each of which is arranged adjacent to each of the original rows, of which writing electrodes 3*b* are arranged in zigzag fashion shown in FIG. 9, wherein the original and additional rows are parallel and extend in the axial direction of the latent image carrier 2 and writing electrodes 3'*b* in each additional row are identical and correspond to those in the adjacent original row, so that two identical writing electrodes 3*b*, 3'*b* are arranged in a line along the direction perpendicular to the axial direction of the latent image carrier 2. The actions and effects of these examples are equal to those of the example shown in FIG. 10(*a*).

FIGS. 11(*a*)–11(*d*) are sectional views each showing an example of the writing electrodes 3*b* of the writing device 3. In the drawings for the aforementioned examples, the writing electrodes 3*b* of the writing device 3 are illustrated with their contact portions to the latent image carrier 2 facing downward. In FIGS. 11(*a*)–11(*d*), however, the writing electrodes are illustrated with their contact portions to the latent image carrier 2 facing upward.

In the writing device 3 of an example shown in FIG. 11(*a*), a resistant layer 13 having a rectangular section is formed on each electrode forming portion of the surface of the conductive pattern (Cu pattern) 9 formed on the substrate 3*a* so as to form each writing electrode 3*b* having double layered structure. The resistant layer 13 can be formed by a conventional known coating method, for example by using an inkjet printer. Another known coating means may be employed instead of the inkjet printer. In case of using an inkjet printer, the thickness of the resistant layer 13 can be controlled with high precision, thereby achieving further accurate control of charge on the latent image carrier 2.

When the resistance value of the writing electrode 3*b* is set at $10^8$ Ω cm or less, a predetermined time constant can be ensured, thus achieving uniform charge. On the other hand, when the resistance value of the writing electrode 3*b* is set at $10^6$ Ω cm or more, the electrostatic breakdown due to pin holes of the charged layer 2*d* of the latent image carrier 2 can be prevented. Therefore, it is preferable that the resistance value of the resistant layer 13 of the writing electrode 3*b* is set in a range from $10^6$ Ω cm to $10^8$ Ω cm. It should be understood that this lower limit of the resistance value may be lower if a blocking layer (thin insulating layer) is provided on the latent image carrier 2.

The writing electrode 3*b* of this example is designed such that the surface of the resistant layer 13 is in plane contact with the charged layer 2*d* of the latent image carrier 2. The function of the resistant layer 13 of the writing electrode 3*b* provided on the conductive pattern 9 prevents the broadening of the contact charge-transfer in the lateral direction. This achieves effective contact charge-transfer between the writing electrode 3*b* and the latent image carrier 2. It should be noted that the resistant layer 13 is not limited to be formed to have a rectangular section as shown in FIG. 11(*a*) and thus may be formed in a half-cylindrical configuration having a semi-circular section which projects upwardly in FIG. 11(*a*) and of which axial direction is perpendicular to the axial direction of the latent image carrier 2. In case of the resistant layer 13 having this half-cylindrical configuration, the resistant layer 13 should be in line contact with the charged layer 2*d* of the latent image carrier 2 along the direction perpendicular to the axial direction of the latent image carrier 2. It should be noted that this line contact may be inclined against the direction perpendicular to the axial direction of the latent image carrier 2.

The resistance of the writing electrode 3*b* is set to be a value equal or less than the resistance of the charged layer 2*d* of the latent image carrier 2 to which the writing electrode 3*b* is in plane contact. The reason is that when the resistance of the writing electrode 3*b* is greater than the resistance of the charged layer 2*d*, the speed of charge response during latent image formation should be easily affected by resistive components adhering to the resistant layer of the writing electrode if any. Therefore, it is preferable that the resistance value of the charged layer 2*d* is set at $10^9$ Ω cm or less.

In the writing device 3 of an example shown in FIG. 11(*b*), the resistant layer 13 of the electrode 3*b* is formed in a semi-circular convex shape projecting upwardly, instead of the shape having a rectangular section of the aforementioned example shown in FIG. 11(*a*). Therefore, the top of the resistant layer 13 is a spherical surface so that the resistant layer 13 is in point contact with the charged layer 2*d* of the latent image carrier 2. According to this structure, contact charge-transfer is conducted at the point contact portion between the resistant layer 13 and the charged layer 2*d* and charge-transfer due to charge leak is also conducted around the point contact portion, whereby application or removal of charge relative to the charged layer 2*d* can be conducted via the contact charge-transfer. Since the surface of the resistant layer 13 is spherical, non-contact charge-transfer is conducted at location around and near the point contact portion between the resistant layer 13 and the charged layer 2*d*. Therefore, application or removal of charge relative to the charged layer 2*d* can be conducted also via the non-contact charge-transfer. Further, this non-contact charge-transfer can achieve uniform application or removal of charge relative to the charged layer 2*d* without formation of portions, as mentioned above, in the charged layer 2*d* which are not subjected to the application or removal of charge. Furthermore, because of point contacts, foreign matters adhering to the surface of the latent image carrier 2 are allowed to pass, thereby preventing filming occurred on the surface of the latent image carrier 2. Still further, since the resistant layer 13 is made of material easily to wear, the surface of the resistant layer 13 should wear to have a fresh surface so that the surface of the resistant layer 13 can be kept fresh, thus also preventing the filming.

In the writing device 3 of an example shown in FIG. 11(*c*), a protective layer 14 is formed as an overcoat on the spherical tops of the resistant layers 13 as the example shown in FIG. 11(*b*) and the surface of the substrate 3*a*. This protective layer 14 makes the surfaces of the resistant layers 13 hard to wear and hard to be adhered with foreign matters.

In the writing device 3 of an example shown in FIG. 11(*d*), a large number of microscopic spherical particles 12 are arranged to be freely roll on the surface of the substrate 3*a* supporting the writing electrodes 3*b* with the resistant layers 13 each having a spherical top as the example shown in FIG. 11(*b*), facilitating passing of foreign matters. With the aid of the microscopic particles 12, foreign matters can easily pass between the writing electrodes 3*b* and the latent image carrier 2 and improved lubrication can be obtained between the writing electrodes 3*b* and the foreign matters, thereby preventing adhering of foreign matters to the writing electrodes 3*b*. These microscopic particles 12 are made of transparent resin such as acrylic resin to have a very small diameter of 1 $\mu$m or less. Since the microscopic particles 12 are made of transparent resin, the microscopic particles 12 never affect the image portions even if the particles 12 move to the image portions.

Figure 12:
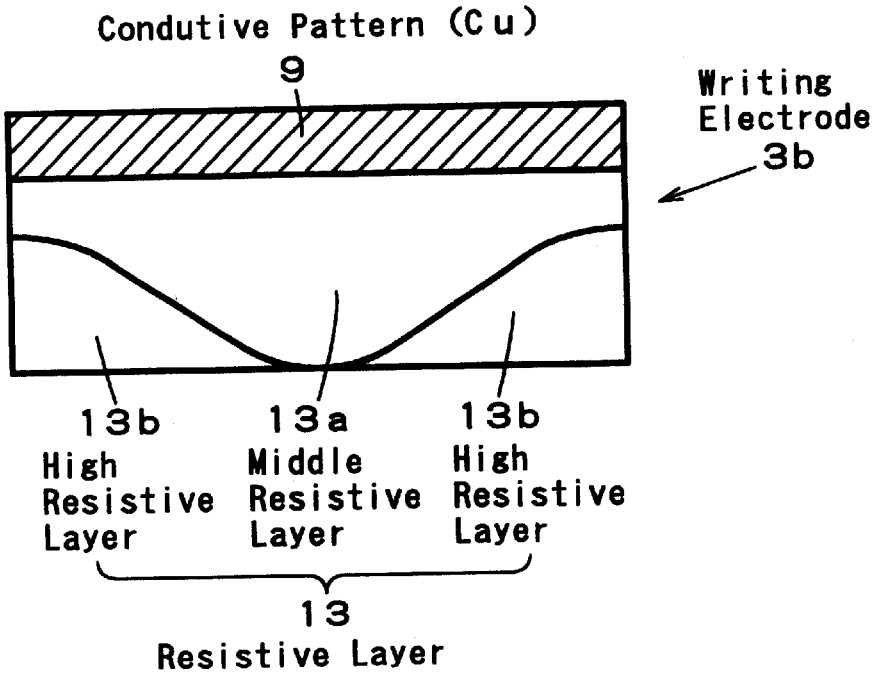
FIG. 12, parts (a)–(b), are views each showing an example of the resistive layer 13 on the writing electrode of the conductive pattern.
Figure 12:
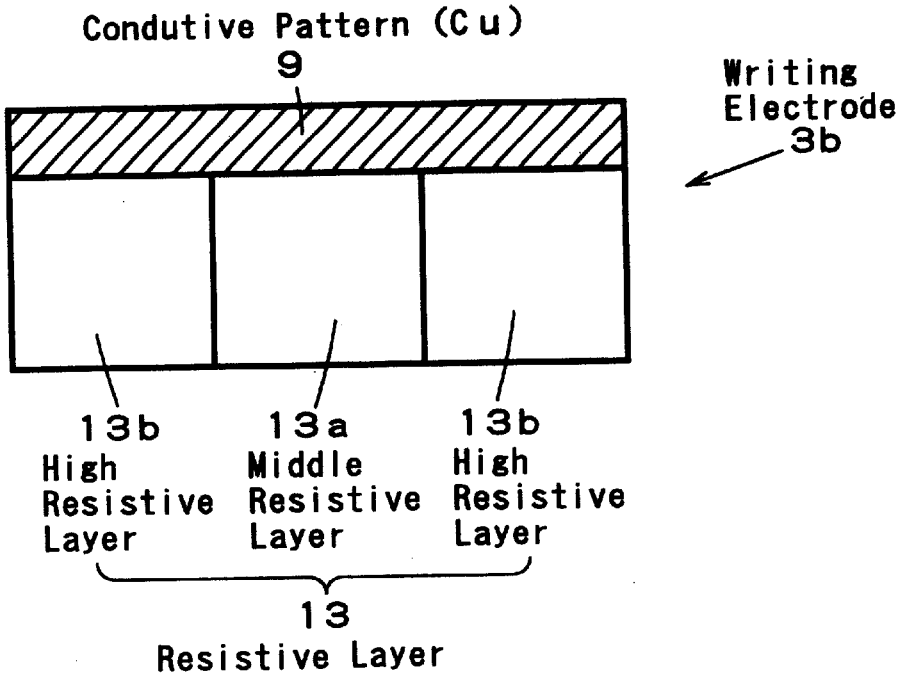

FIGS. 12(*a*) and 12(*b*) are views each showing an example of the resistive layer 13 on the writing electrode 3*b* of the conductive pattern 9.

As shown in FIG. 12(*a*), the writing electrode 3*b* of this example has a middle resistive layer 13*a* extending over the entire surface of a portion, for formation of the writing electrode 3*b*, of the conductive pattern 9. The thickness of the middle resistive layer 13*a* is largest at the center of the writing electrode 3*b* and is gradually reduced toward peripheral edges. The writing electrode 3*d* also includes a high resistive layer 13*b* of which resistance is higher than that of the middle resistive layer 13*a*. In this case, the thickness of the resistive layer 13 is constant as a whole so that the middle resistive layer 13*a* is exposed from the high resistive layer 13*b* in a region about the center. Therefore, the thickness of the high resistive layer 13*b* is largest at peripheral edges, is gradually reduced toward the center, and none at the region where the middle resistive layer 13*a* is exposed. According to this structure, the resistance of the center of the writing electrode 3*b* is set lower than the resistance at the peripheral edges of the writing electrode 3*b*. Therefore, the contact charge-transfer between the writing electrode 3*b* and the latent image carrier 2 is greater at the center of the writing electrode 3*b* and is smaller at the peripheral edges. The writing electrode 3*b* generally has a three-layered structure.

The resistance of the center of the writing electrode 3*b* is set lower than the resistance at the peripheral edges of the writing electrode 3*b* as mentioned, thereby reducing electric fields at edges of the writing electrode 3*b*. This reduces transfer residues on portions corresponding to the edges of the writing electrode 3*b*.

Figure 13:
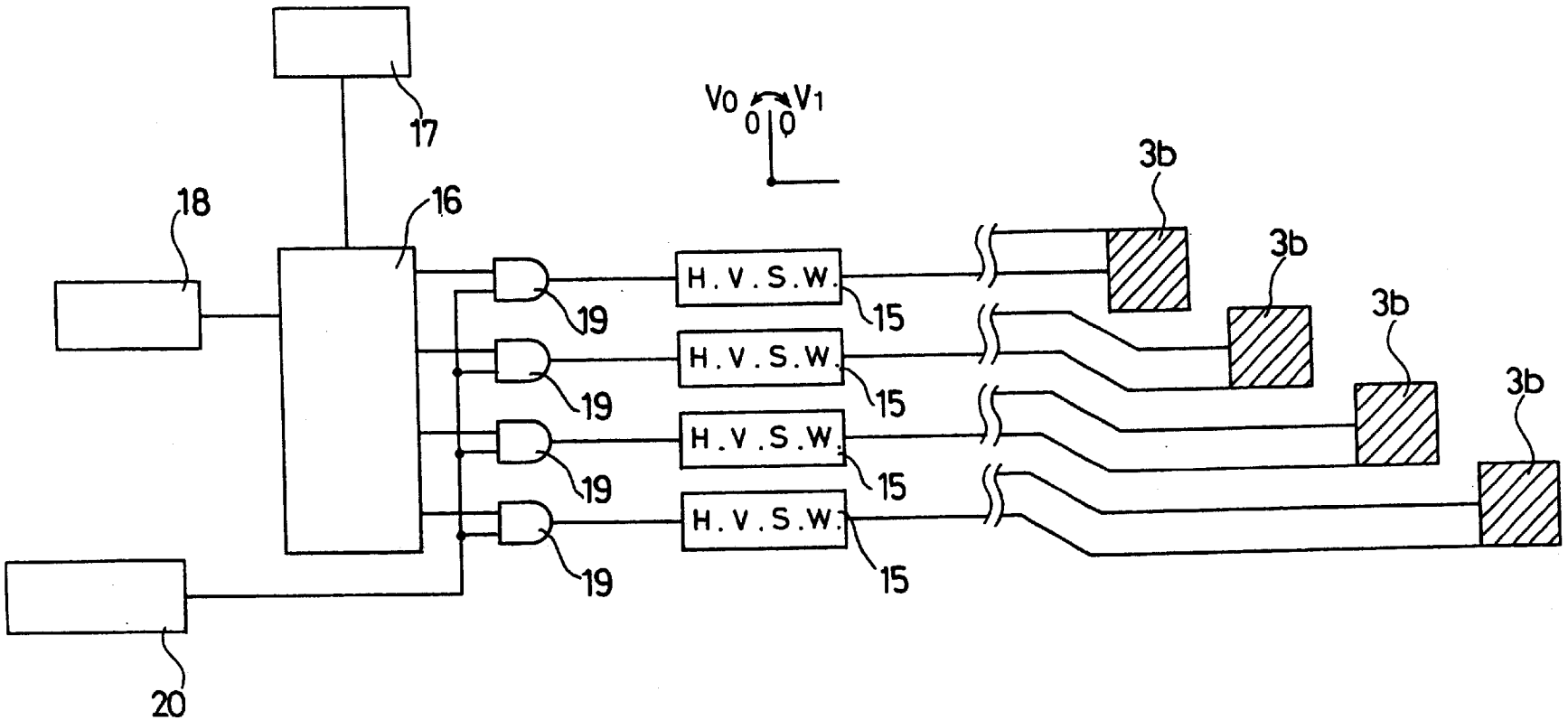
FIG. 13 is a diagram showing a switching circuit for switching the voltage to be supplied to the writing electrodes between the predetermined voltage $V_0$ and the ground voltage $V_1$.

FIG. 13 is a diagram showing a switching circuit for switching the voltage to be connected to the writing electrodes 3*b* between the predetermined voltage $V_0$ and the ground voltage $V_1$.

As shown in FIG. 13, the writing electrodes 3*b* which is arranged, for example, in four lines are connected to corresponding high voltage switches (H.V.S.W.) 15, respectively. Each of the high voltage switches 15 can switch the voltage to be supplied to the corresponding electrode 3*b* between the predetermined voltage $V_0$ and the ground voltage $V_1$. An image writing control signal is inputted into each high voltage switch 15 from a shift resistor (S.R.) 16, to which an image signal stored in a buffer 17 and a clock signal from a clock 18 are inputted. The image writing control signal is inputted into each high voltage switch 15 through each AND circuit 19 in accordance with a writing timing signal from an encoder 20. The high voltage switch 15 and the AND circuit 19 cooperate together to form the aforementioned driver 11 which controls the supply voltage for the corresponding electrodes 3*b*.

Figure 14:
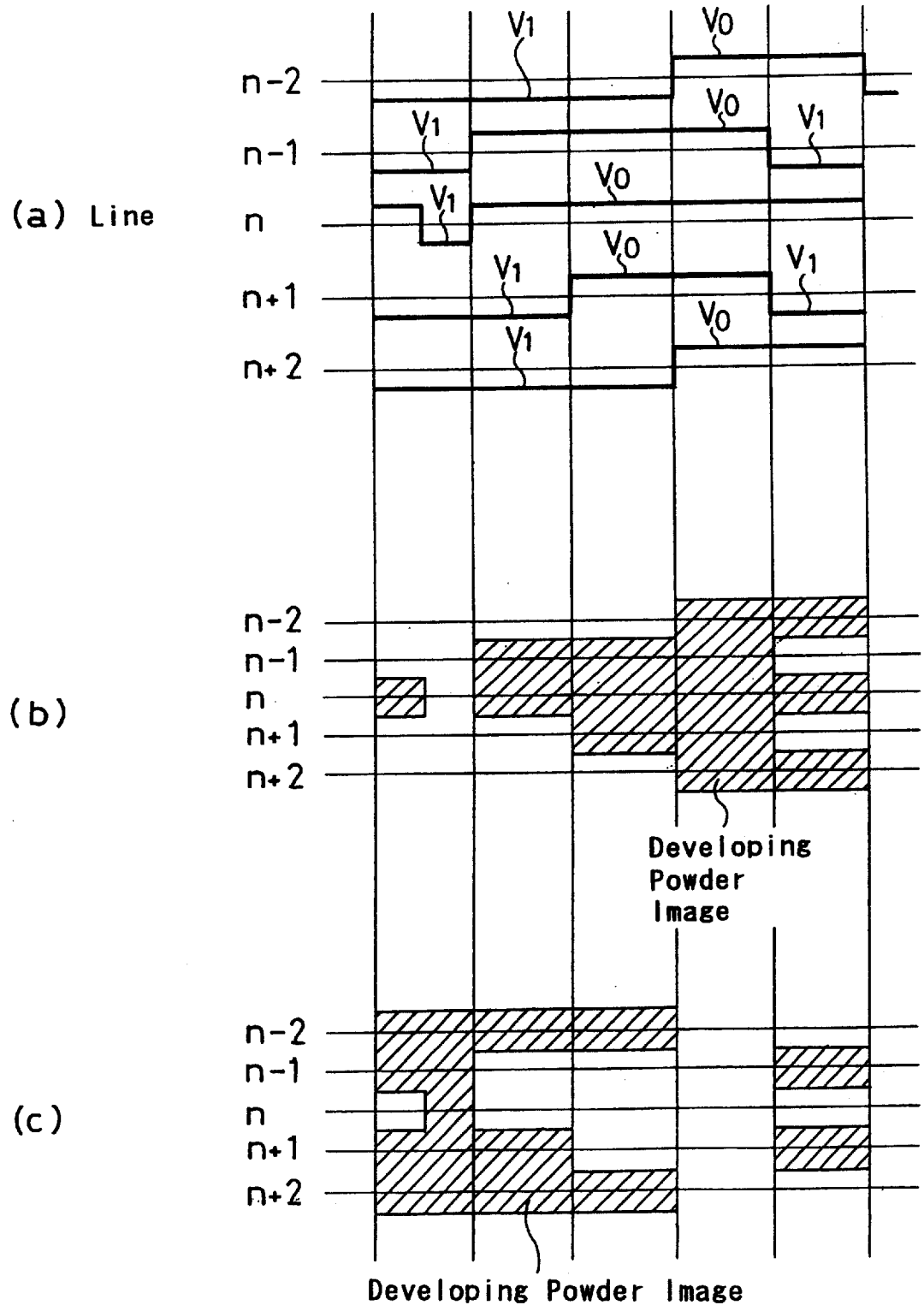
FIG. 14, parts (a)–(c), show profiles when the supply voltage for each electrode is selectively controlled into the predetermined voltage $V_0$ or the ground voltage $V_1$ by switching operation of the corresponding high voltage switch, wherein part (a) is a diagram showing the voltage profiles of the respective electrodes, part (b) is a diagram showing a developing powder image obtained by normal developing with the voltage profiles shown in part (a), and part (c) is a diagram showing a developing powder image obtained by reverse developing with the voltage profiles shown in part (a)

FIGS. 14(*a*)–14(*c*) show profiles when the supply voltage for each electrode 3*b* is selectively controlled into the predetermined voltage $V_0$ or the ground voltage $V_1$ by switching operation of the corresponding high voltage switch 15, wherein FIG. 14(*a*) is a diagram showing the voltage profiles of the respective electrodes, FIG. 14(*b*) is a diagram showing a developing powder image obtained by normal developing with the voltage profiles shown in FIG. 14(*a*), and FIG. 14(*c*) is a diagram showing a developing powder image obtained by reverse developing with the voltage profiles shown in FIG. 14(*a*).

Assuming that the electrodes 3*b*, for example as shown in FIGS. 14(*a*)–14(*c*), five electrodes indicated by n−2, n−1, n, n+1, and n+2, respectively, are controlled to be into the voltage profiles shown in FIG. 14(*a*) by switching operation of the respective high voltage switches 15. When an electrostatic latent image is written on the latent image carrier 2 with the electrodes 3*b* having the aforementioned voltage profiles and is then developed normally, the developing powder 8 adheres to portions at the predetermined voltage $V_0$ of the latent image carrier 2, thereby obtaining a developing powder image as shown by hatched portions in FIG. 14(*b*). When an electrostatic latent image is written in the same manner and is then developed reversely, the developing powder 8 adheres to portions at the ground voltage $V_1$ of the latent image carrier 2, thereby obtaining a developing powder image as shown by hatched portions in FIG. 14(*c*).

According to the image forming apparatus 1 employing the writing device 3 having the aforementioned structure, the writing electrodes 3*b* are supported by the flexible substrate 3*a* and are pressed lightly against and in contact with the latent image carrier 2 by weak elastic restoring force of the substrate 3*a*, thereby stabilizing the positions of the writing electrodes 3*b* relative to the latent image carrier 2 and thus stably and reliably conducting contact charge-transfer between the writing electrodes 3*b* and the latent image carrier 2. Therefore, application or removal of charge relative to the latent image carrier 2 by the writing electrodes 3*b* can be further stably conducted with high precision, thereby achieving stable writing of an electrostatic latent image and thus reliably obtaining a high quality image with high precision.

Since the application or removal of charge relative to the latent image carrier 2 is made mainly via contact charge-transfer between the writing electrodes 3*b* and the latent image carrier 2, an electrostatic latent image can be easily written on the latent image carrier 2 by using the writing electrodes 3*b*. In the application or removal of charge via contact charge-transfer, charge is directly transferred between the writing electrodes 3*b* and the latent image carrier 2 so that the surface potential of the latent image carrier 2 becomes substantially equal to the voltage impressed to the writing electrodes 3*b*. Therefore, low voltage is enough to be impressed to the writing electrodes 3*b*.

By setting the resistance value of the writing electrode at $10^8$ Ω cm or less, a predetermined time constant can be ensured, thus achieving uniform charge. On the other hand, by setting the resistance value of the writing electrode 3*b* at $10^6\Omega$ cm or more, the electrostatic breakdown due to pin holes of the charged layer 2*d* of the latent image carrier 2 can be prevented.

The writing electrode 3*b* on the conductive pattern 9 is provided with the resistant layer 13, thereby preventing the broadening of the contact charge-transfer in the lateral direction. This achieves effective contact charge-transfer between the writing electrode 3*b* and the latent image carrier 2.

Since the writing electrodes 3*b* are kept in contact with the latent image carrier 2 by a small pressing force, the latent image carrier 2 can be prevented from being damaged by the writing electrodes 3*b*, thus improving the durability of the latent image carrier 2.

Further, since the writing device 3 employs only the writing electrodes 3*b* without using a laser beam generating device or a LED light generating device which is large in size as conventionally used, the apparatus size can be reduced and the number of parts can also be reduced, thereby obtaining an image forming apparatus which is simple and low-price.

Furthermore, generation of ozone can be further reduced by the writing electrodes 3*b*.

The writing electrodes 3*b* are kept in contact with the latent image carrier 2 with a small pressing force created by the flexible substrate 3*a*, there is little or no gap (space) between the writing electrodes 3*b* and the latent image carrier 2. Because of the little or no gap, air undesirably ionized is practically non-existent, thereby further reducing the generation of ozone and enabling the formation of an electrostatic latent image with low potential.

Hereinafter, description will now be made as regard to the image forming apparatus employing the writing device according to the present invention, which brings the electrodes 3*b* into contact with the latent image carrier 2 to write an electrostatic latent image.

Figure 15:
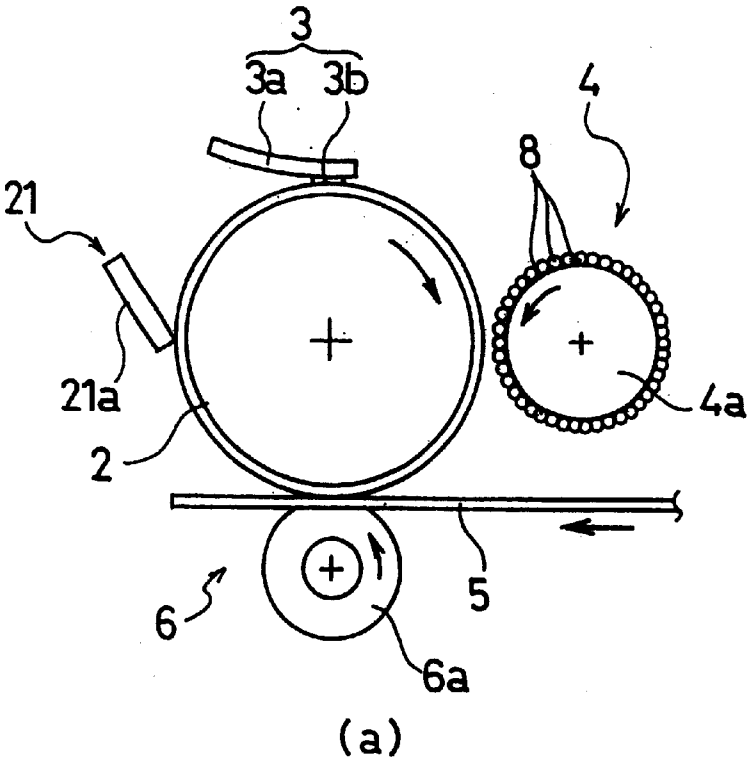
FIG. 15, parts (a) and parts (b) schematically show an example of the image forming apparatus employing the writing device according to the present invention, wherein part (a) is a view showing an image forming apparatus with a cleaner, and part (b) is a view showing an image forming apparatus without a cleaner.
Figure 15:
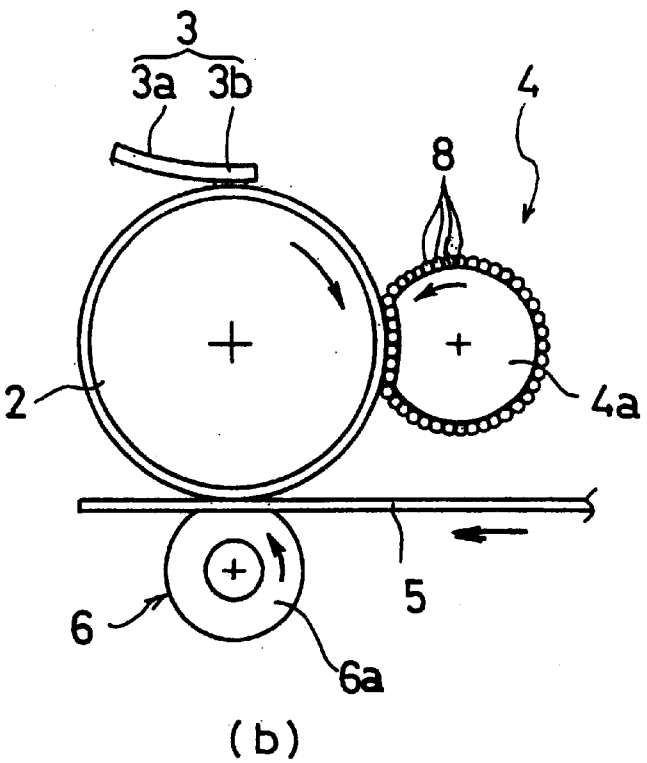

FIGS. 15(*a*) and 15(*b*) schematically show examples of the image forming apparatus employing the writing device according to the present invention, wherein FIG. 15(*a*) is a view showing an image forming apparatus with a cleaner, and FIG. 15(*b*) is a view showing a cleaner-less image forming apparatus without a cleaner.

The image forming apparatus 1 shown in FIG. 15(*a*) is a black-and-white image forming apparatus, in which the substrate 3*a* of the writing device 3 extends from the upstream side to the downstream side of the rotational direction of the latent image carrier 2 and the writing electrodes 3*b* fixed at the end of the substrate 3*a* are kept in contact with the surface of the latent image carrier 2 by a small pressing force due to a weak elastic restoring force of the substrate 3*a*. This apparatus is provided with a cleaning device 21 at a downstream side than the transferring device 6 in the rotational direction of the latent image carrier 2. The aforementioned charge control device 7 may be disposed between the writing device 3 and the cleaning device 21, but not illustrated. In case of no charge control device 7, a new latent image is substituted on the former latent image, but the number of parts and the apparatus size can be reduced because of the elimination of the charge control device 7.

In the black-and-white image forming apparatus 1 having the aforementioned structure, after the surface of the latent image carrier 2 is made into the uniformly charged state by the charge control device 7, the writing electrodes 3*b* of the writing device 3 write an electrostatic latent image to be formed by applying charge to or removing charge from the surface of the latent image carrier 2 mainly via contact charge-transfer because the writing electrodes 3*b* are arranged in contact with the latent image carrier 2 just as mentioned above. The latent image on the latent image carrier 2 is subsequently developed with developing powder by the developing powder carrier 4*a* of the developing device 4, which is spaced apart from the latent image carrier 2, to form a developing powder image. Then, the developing powder image on the latent image carrier 2 is transferred to a receiving medium 5 by the transferring device 6. Residual developing powder on the latent image carrier 2 after the transfer is removed by a cleaning blade 21*a* of the cleaning device 21 and cleaned surface of the latent image carrier 2 is uniformly charged by the charge control device 7 again. The image forming apparatus 1 can be manufactured to have a smaller size and simple structure because it employs the writing device 3 of the present invention.

The image forming apparatus 1 shown in FIG. 15(*b*) is similar to the image forming apparatus 1 shown in FIG. 15(*a*), but without having the cleaning device 21, that is, it is a cleaner-less image forming apparatus. In the image forming apparatus 1 of this example, the developing powder carrier 4*a* of the developing device 4 is in contact with the latent image carrier 2 so as to conduct contact developing.

In the image forming apparatus 1 of this example having the aforementioned structure, the surface of the latent image carrier 2 is uniformly charged by the charge control device 7 together with residual developing powder on the latent image carrier after the former transfer. Then, the writing electrodes 3*b* of the writing device 3 write an electrostatic latent image on the surface of the latent image carrier 2 and the residual developing powder by applying charge to or removing charge from the surface of the latent image carrier 2 and the surface of the residual developing powder mainly via contact charge-transfer because the writing electrodes 3*b* are arranged in contact with the latent image carrier 2. By the developing device 4, the latent image is developed. During this, by selectively charging the writing electrodes 3*b* to have the same polarity as the original polarity of the developing powder 8, residual developing powder on non-image portions of the latent image carrier 2 is charged into the polarity by the writing electrodes 3*b* so as to move toward the developing device 4, while residual developing powder on image portions of the latent image carrier 2 still remains on the latent image carrier 2 as developing powder for subsequent developing. By transferring the residual developing powder on the non-image portions toward the developing device 2 as mentioned above, the surface of the latent image carrier 4 can be cleaned even without the cleaning device 21. In particular, a brush may be arranged at a downstream side than the transferring device 6 in the rotational direction of the latent image carrier 2, but not illustrated. In this case, the residual developing powder can be scattered to be uniformly distributed on the latent image carrier by this brush, thus further effectively transferring the residual developing powder on the non-image portions to the developing device 4.

The other actions of the image forming apparatus 1 of this example are the same as those of the image forming apparatus 1 shown in FIG. 15(*a*). Employment of the writing device 3 of the present invention achieves reduction in size and simplification of the structure of the image forming apparatus 1. Particularly, since it is a cleaner-less image forming apparatus without the cleaning device 21, further simple structure can be achieved.

Figure 16:
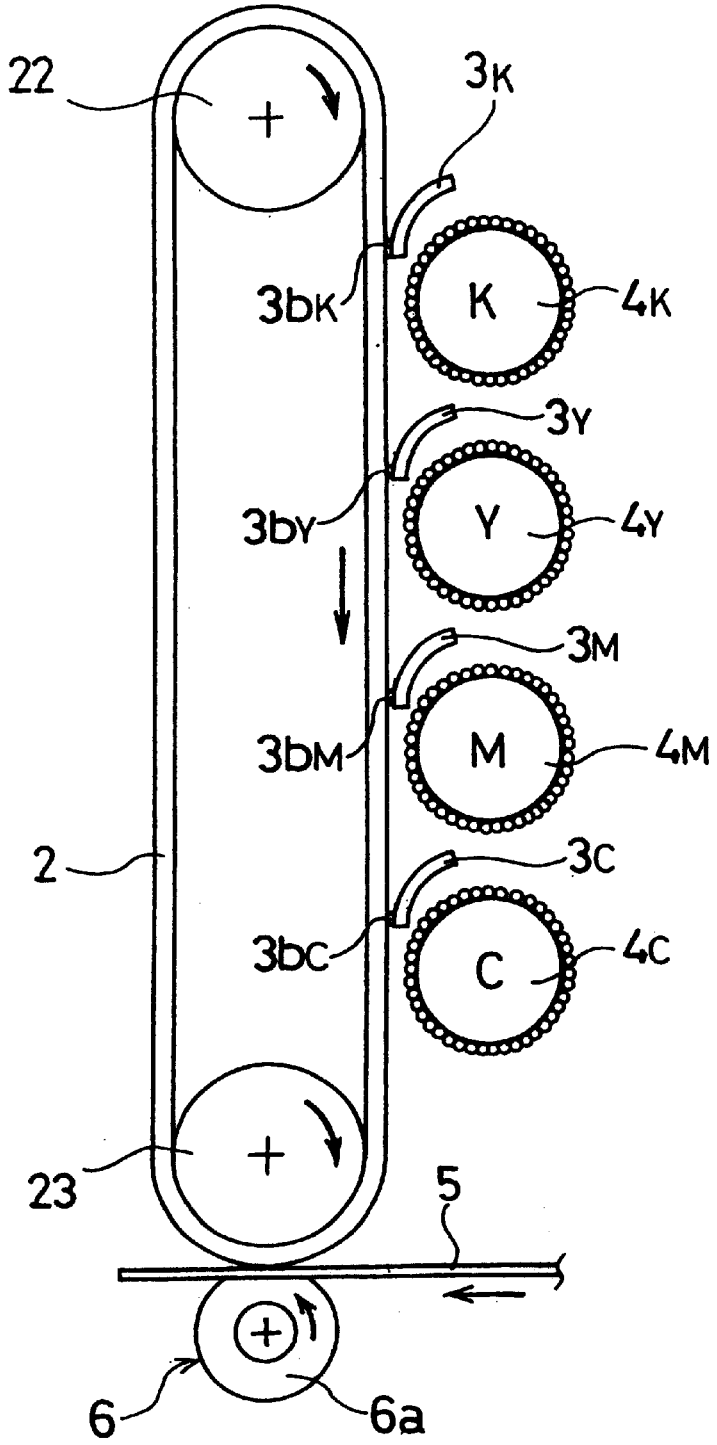
FIG. 16 is a view schematically showing another example of the image forming apparatus employing the writing device according to the present invention.

FIG. 16 is a view schematically showing another example of the image forming apparatus employing the writing device according to the present invention.

As shown in FIG. 16, the image forming apparatus 1 of this example is a color image forming apparatus for developing full color image by superposing developing powder images in four colors of black K, yellow Y, magenta M, and cyan C on a latent image carrier 2 taking the form as an endless belt. This endless belt-like latent image carrier 2 is tightly held by two rollers 22, 23 and is rotatable in the clockwise direction in FIG. 16 by a driven roller, i.e. one of the rollers 22, 23.

Writing devices $\mathbf{3}_K$, $\mathbf{3}_Y$, $\mathbf{3}_M$, $\mathbf{3}_C$ and developing devices $\mathbf{4}_K$, $\mathbf{4}_Y$, $\mathbf{4}_M$, $\mathbf{4}_C$ for the respective colors are arranged along a straight portion of the endless belt of the latent image carrier 2, in the order of colors K, Y, M, C from the upstream of the rotational direction of the latent image carrier 2. It should be understood that the developing devices $\mathbf{4}_K$, $\mathbf{4}_Y$, $\mathbf{4}_M$, $\mathbf{4}_C$ may be arranged in any order other than the illustrated one. All of the respective writing electrodes $\mathbf{3}b_K$, $\mathbf{3}b_Y$, $\mathbf{3}b_M$, $\mathbf{3}b_C$ of the writing devices $\mathbf{3}_K$, $\mathbf{3}_Y$, $\mathbf{3}_M$, $\mathbf{3}_C$ are kept in contact with the latent image carrier 2 with a small pressing force as mentioned above. Also in the image forming apparatus of this example, the aforementioned charge control device 7 is disposed adjacent to a straight portion of the endless belt of the latent image carrier 2, at a side opposite to the side where the writing devices $\mathbf{3}_K$, $\mathbf{3}_Y$, $\mathbf{3}_M$, $\mathbf{3}_C$ are arranged, but not illustrated.

In the image forming apparatus 1 of this example having the aforementioned structure, an electrostatic latent image for black K is written on the surface of the latent image carrier 2 mainly via contact charge-transfer because the electrodes $\mathbf{3}b_K$ of the writing device $\mathbf{3}_K$ for black K are in contact with the latent image carrier 2. The electrostatic latent image for black K is then developed by the developing device $\mathbf{4}_K$ so as to form a black developing powder image on the surface of the latent image carrier 2. An electrostatic latent image for yellow Y is subsequently written on the surface of the latent image carrier 2 and on the black developing powder image, already formed, mainly via contact charge-transfer by the electrodes $\mathbf{3}b_Y$ of the writing device $\mathbf{3}_Y$ for yellow Y such that the electrostatic latent image for yellow Y is partly superposed on the black developing powder image. The electrostatic latent image for yellow Y is then developed by the developing device $\mathbf{4}_Y$ so as to form a yellow developing powder image on the surface of the latent image carrier 2. In the same manner, an electrostatic latent image for magenta M is subsequently written on the surface of the latent image carrier 2 and on the black and yellow developing powder images, already formed, mainly via contact charge-transfer by the electrodes $\mathbf{3}b_M$ of the writing device $\mathbf{3}_M$ for magenta M such that the electrostatic latent image for magenta M is partly superposed on the black and yellow developing powder images. The electrostatic latent image for magenta M is then developed by the developing device $\mathbf{4}_M$ so as to form a magenta developing powder image on the black and yellow developing powder images and the surface of the latent image carrier 2. Moreover, an electrostatic latent image for cyan C is subsequently written on the surface of the latent image carrier 2 and on the black, yellow and magenta developing powder images, already formed, mainly via contact charge-transfer by the electrodes $\mathbf{3}b_C$ of the writing device $\mathbf{3}_C$ for cyan C such that the electrostatic latent image for cyan C is partly superposed on the black, yellow and magenta developing powder images. The electrostatic latent image for cyan C is then developed by the developing device $\mathbf{4}_C$ so as to form a cyan developing powder image on the black, yellow and magenta developing powder images and the surface of the latent image carrier 2. These developing powder images are toned. Then, these developing powder images are transferred to the receiving medium 5 by the transferring device 6 to form a multicolored developing powder image on the receiving medium 5. It should be understood that the developing powder of colors may be deposited in any order other than the aforementioned order.

Accordingly, employment of the writing devices 3 of the present invention still achieves reduction in size and simplification of the structure of such a color image forming apparatus for forming a multicolored developing powder image by superposing and toning the developing powder images for the respective colors on a latent image carrier 2.

Figure 17:
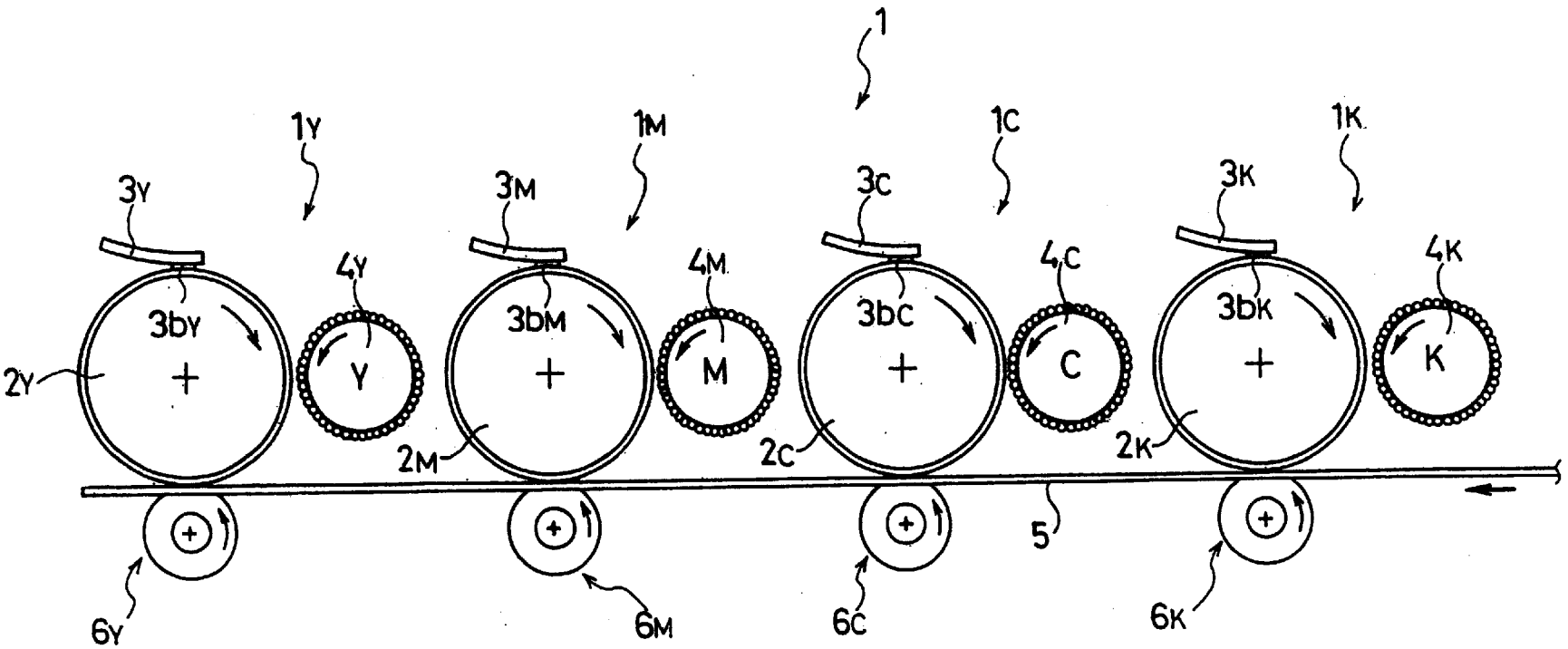
FIG. 17 is a view schematically showing still another example of the image forming apparatus employing the writing device according to the present invention.

FIG. 17 is a view schematically showing still another example of the image forming apparatus employing the writing device according to the present invention.

As shown in FIG. 17, the image forming apparatus 1 of this example comprises image forming units $\mathbf{1}_K$, $\mathbf{1}_C$, $\mathbf{1}_M$, $\mathbf{1}_Y$ for the respective colors which are arranged in tandem in this order from the upstream in the feeding direction of a receiving medium 5. It should be understood that the image forming units $\mathbf{1}_K$, $\mathbf{1}_C$, $\mathbf{1}_M$, $\mathbf{1}_Y$ may be arranged in any order. The image forming units $\mathbf{1}_K$, $\mathbf{1}_C$, $\mathbf{1}_M$, $\mathbf{1}_Y$ comprises latent image carriers $\mathbf{2}_K$, $\mathbf{2}_C$, $\mathbf{2}_M$, $\mathbf{2}_Y$,writing devices $\mathbf{3}_K$, $\mathbf{3}_C$, $\mathbf{3}_M$, $\mathbf{3}_Y$, developing devices $\mathbf{4}_K$, $\mathbf{4}_C$, $\mathbf{4}_M$, $\mathbf{4}_Y$, and transferring devices $\mathbf{6}_K$, $\mathbf{6}_C$, $\mathbf{6}_M$, $\mathbf{6}_Y$, respectively. In the image forming units $\mathbf{1}_K$, $\mathbf{1}_C$, $\mathbf{1}_M$, $\mathbf{1}_Y$ of this example, but not illustrated, the aforementioned charge control devices 7 may be disposed on the upstream sides of the writing devices $\mathbf{3}_K$, $\mathbf{3}_C$, $\mathbf{3}_M$, $\mathbf{3}_Y$ in the rotational direction of the latent image carriers $\mathbf{2}_K$, $\mathbf{2}_C$, $\mathbf{2}_M$, $\mathbf{2}_Y$,respectively.

The actions of the image forming apparatus 1 of this example having the aforementioned structure will now be described. First in the image forming unit $\mathbf{1}_K$ for black K, after the surface of the latent image carrier $\mathbf{2}_K$ is uniformly charged by the charge control device 7 for black K, an electrostatic latent image for black K is written on the surface of the latent image carrier $\mathbf{2}_K$ mainly via contact charge-transfer by the writing electrodes $\mathbf{3}b_K$ of the writing device $\mathbf{3}_K$. The electrostatic latent image for black K is then developed by the developing device $\mathbf{4}_K$ so as to form a black developing powder image on the surface of the latent image carrier $\mathbf{2}_K$. The black developing powder image on the latent image carrier $\mathbf{2}_K$ is transferred to the receiving medium 5 supplied so as to form a black developing powder image on the receiving medium 5. Subsequently, in the image forming unit $\mathbf{1}_C$ for cyan C, after the surface of the latent image carrier $\mathbf{2}_C$ is uniformly charged by the charge control device 7 for cyan C, an electrostatic latent image for cyan C is written on the surface of the latent image carrier $\mathbf{2}_C$ mainly via contact charge-transfer by the writing electrodes $\mathbf{3}b_C$ of the writing device $\mathbf{3}_C$. The electrostatic latent image for cyan C is then developed by the developing device $\mathbf{4}_C$ so as to form a cyan developing powder image on the surface of the latent image carrier $\mathbf{2}_C$. The cyan developing powder image on the latent image carrier $\mathbf{2}_C$ is transferred by the transferring device $\mathbf{6}_C$ to the receiving medium 5, supplied and already having the black developing powder image thereon, such that the cyan developing powder image is formed to be partly superposed on the black developing powder image on the receiving medium 5. In the same manner, in the image forming unit $\mathbf{1}_M$ for magenta M, after the surface of the latent image carrier $\mathbf{2}_M$ is uniformly charged by the charge control device 7 for magenta M, an electrostatic latent image for magenta M is written on the surface of the latent image carrier $\mathbf{2}_M$ mainly via contact charge-transfer by the wring electrodes $\mathbf{3}b_M$ of the writing device $\mathbf{3}_M$. The electrostatic latent image for magenta M is then developed by the developing device $4_M$ so as to form a magenta developing powder image on the surface of the latent image carrier $2_M$. The magenta developing powder image on the latent image carrier $2_M$ is transferred to the receiving medium 5 such that the magenta developing powder image is formed and partly superposed on the developing powder images already formed on the receiving medium 5. Then, in the image forming unit $1_Y$ for yellow Y, after the surface of the latent image carrier $2_Y$ is uniformly charged by the charge control device 7 for yellow Y, an electrostatic latent image for yellow Y is written on the surface of the latent image carrier $2_Y$ mainly via contact charge-transfer by the writing electrodes $2b_Y$ of the writing device $2_Y$ and then developed by the developing device $4_M$ so as to form a yellow developing powder image on the surface of the latent image carrier $2_Y$. The yellow developing powder image on the latent image carrier $2_Y$ is transferred to the receiving medium 5 such that the yellow developing powder image is formed and partly superposed on the developing powder images already formed on the receiving medium 5, thereby producing a toned multicolored developing powder image on the receiving medium 5.

Accordingly, employment of the writing devices 3 of the present invention still achieves reduction in size and simplification of the structure of such a color image forming apparatus comprising image forming units $1_K$, $1_C$, $1_M$, $1_Y$ for the respective colors arranged in tandem.

Figure 18:
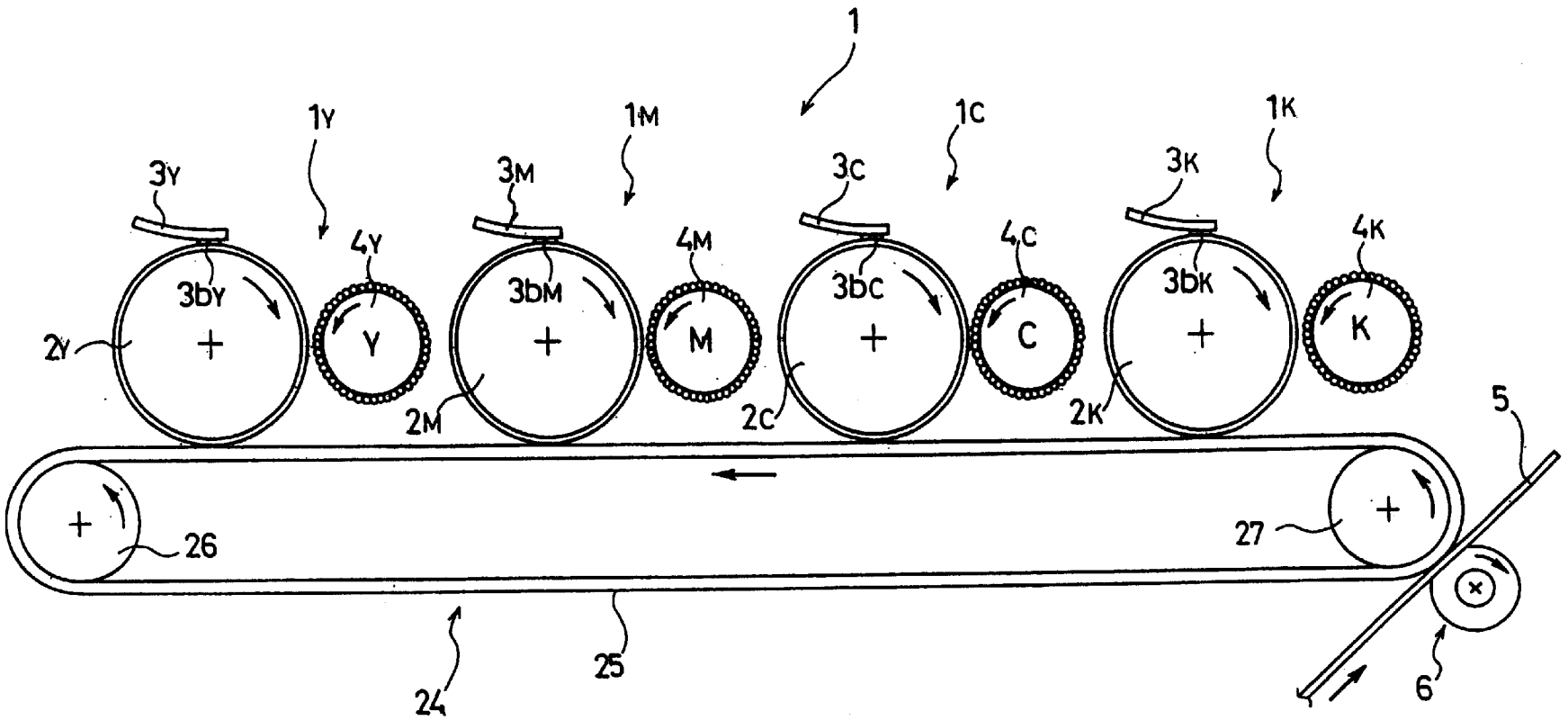
FIG. 18 is a view schematically showing further another example of the image forming apparatus employing the writing device according to the present invention.

FIG. 18 is a view schematically showing further another example of the image forming apparatus employing the writing device according to the present invention.

In the image forming apparatus 1 of the example shown in FIG. 17 comprising the image forming units $1_K$, $1_C$, $1_M$, $1_Y$ for the respective colors which are arranged in tandem, respective color developing powder images formed on the latent image carriers $2_K$, $2_C$, $2_M$, $2_Y$ of the image forming units $1_K$, $1_C$, $1_M$, $1_Y$ are transferred to the receiving medium 5 at every unit $1_K$, $1_C$, $1_M$, $1_Y$. In the image forming apparatus 1 of this example, however, the respective color developing powder images are temporally transferred to another medium before transferred to the receiving medium 5 as shown in FIG. 18. That is, the image forming apparatus 1 of this example is different from the image forming apparatus 1 of the example shown in FIG. 17 by including an intermediate transferring device 24. The intermediate transferring device 24 comprises an intermediate transferring member 25 taking the form as an endless belt. This intermediate transferring member 25 is tightly held by two rollers 26, 27 and is rotated in the counter-clockwise direction in FIG. 18 by the drive of one of the rollers 26, 27.

Image forming units $1_K$, $1_C$, $1_M$, $1_Y$ are arranged along a straight portion of the intermediate transferring member 25. Further, the image forming apparatus 1 has a transferring device 6 disposed adjacent to the roller 27. The other structures of the image forming apparatus 1 of this example are the same as those of the image forming apparatus 1 of the example shown in FIG. 17.

In the image forming apparatus 1 of this example having the aforementioned structure, developing powder images for the respective colors are formed on the latent image carriers $2_K$, $2_C$, $2_M$, $2_Y$ in the same manner as the image forming apparatus 1 of the example shown in FIG. 17, and the developing powder images for the respective colors are transferred to the intermediate transferring member 25 to be superposed on each other and toned in the same manner as the case of transferring developing powder images to the receiving medium 5 as shown in FIG. 17. The developing powder images for the respective colors temporally transferred to the intermediate transferring member 25 are transferred to the receiving medium 5 by the transferring device 6 so as to form a multicolored developing powder image on the receiving medium 5. The other actions of the image forming apparatus 1 of this example are the same as those of the image forming apparatus 1 of the example shown in FIG. 17.

Accordingly, employment of the writing devices 3 of the present invention still achieves reduction in size and simplification of the structure of such a color image forming apparatus comprising an intermediate transferring device 24 and image forming units $1_K$, $1_C$, $1_M$, $1_Y$ for the respective colors arranged in tandem.

Figure 19:
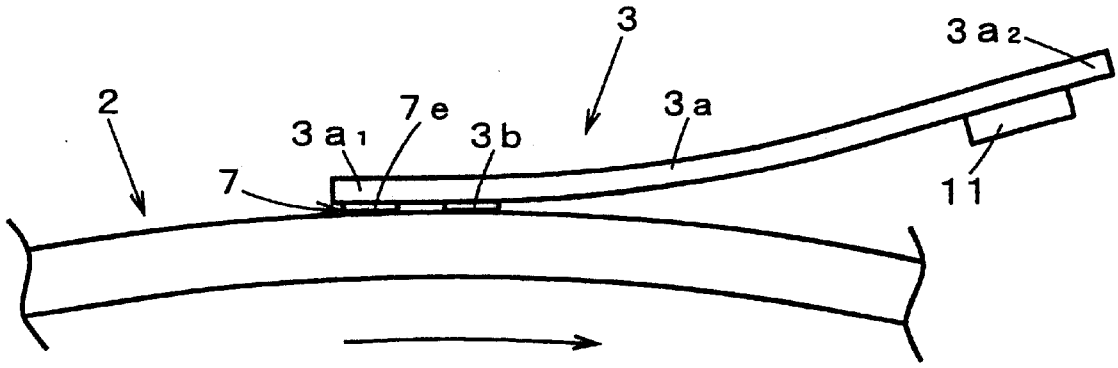
FIG. 19 is a view similar to FIG. 5 but schematically and partially showing another example of the image forming apparatus according to the present invention.

FIG. 19 is a view similar to FIG. 5 but schematically and partially showing another example of the image forming apparatus according to the present invention.

In any of the aforementioned examples, the charge control device 7 for uniformly charging the latent image carrier 2 is provided separately from the writing device 3. In the image forming apparatus 1 of this example, the charge control device 7 is disposed on the substrate 3*a* of the writing device 3 as well as the writing electrodes 3*a*. That is, a uniformly charging electrode 7*e* of the charge control device 7 is disposed on the end 3*a*1 of the substrate 3*a* of the writing device 3 in such a manner that the writing electrodes 3*b* are spaced apart from the uniformly charging electrode 7*e* at a predetermined gap. In this case, the uniformly charging electrode 7*e* is formed into a thin plate-like shape having a rectangular section. The uniformly charging electrode 7*e* is continuously disposed to extend in the axial direction of the latent image carrier 2 along the same length as the axial length of the charged layer 2*d* of the latent image carrier 2. The writing electrodes 3*b* and the uniformly charging electrode 7 are kept in contact with the surface of the latent image carrier 2 with a small pressing force by weak elastic restoring force created by deflection of the substrate 3*a*.

In the image forming apparatus 1 of this example having the aforementioned structure, after the surface of the latent image carrier 2 is uniformly charged by the uniformly charging electrode 7*e* on the end $3a_1$ of the substrate 3*a*, the writing electrodes 3*b* write an electrostatic latent image on the surface of the latent image carrier 2 by applying charge to or removing charge from selected areas of the surface of the latent image carrier 2.

In the image forming apparatus of this example, the uniformly charging electrode 7*e* and the writing electrodes 3*b* are disposed together, thereby allowing the manufacture of an image forming apparatus 1 which is smaller in size and simpler in structure. The other structures, actions, and effects of the image forming apparatus of this example are the same as those of the example shown in FIG. 5.

It should be understood that the design of providing the uniformly charging electrode 7*e* and the writing electrodes 3*b* as one unit is not limited to the illustrated example shown in FIG. 19, may be applied to any of the image forming apparatuses of the aforementioned examples and, in addition, any case applied with this design can exhibit the same works and effects. A suitable insulator may be arranged in the gap between the writing electrodes 3*b* and the uniformly charging electrode 7*e*.

As apparent from the aforementioned description, in the image forming apparatus of the present invention, application or removal of charge relative to the latent image carrier is conducted mainly via charge-transfer between the writing electrodes and the latent image carrier which are in plane contact with each other, thereby stably and reliably conducting the charge-transfer between the writing electrodes and the latent image carrier and thus enabling easy writing of an electrostatic latent image onto the latent image carrier. In the application or removal of charge via charge-transfer, since charge is directly transferred between the writing electrodes and the latent image carrier which are in contact with each other, the surface potential of the latent image carrier becomes substantially equal to the voltage to be impressed to the writing electrodes, thereby allowing the voltage to be impressed to the writing electrodes to be set at a relatively low voltage.

The writing electrodes are supported by the substrate having elasticity and are kept in contact with the latent image carrier with a small pressing force by weak elastic restoring force of the substrate, thereby stabilizing the positions of the writing electrodes relative to the latent image carrier and thus stably and reliably conducting charge-transfer between the writing electrodes and the latent image carrier. Therefore, application or removal of charge relative to the latent image carrier by the writing electrodes can be further stably conducted with high precision, thereby achieving stable writing of an electrostatic latent image and thus reliably obtaining a high quality image with high precision.

The writing electrodes are kept in contact with the latent image carrier with a small pressing force by the substrate having elasticity, there is little or no gap (space) between the writing electrodes and the latent image carrier. Because of the little or no gap, air undesirably ionized is practically non-existent, thereby further reducing the generation of ozone and enabling the formation of an electrostatic latent image with low potential. Since the writing electrodes are kept in contact with the latent image carrier by the small pressing force, the latent image carrier can be prevented from being damaged by the writing electrodes, thus improving the durability of the latent image carrier.

Further, since the resistance of the writing electrode is set to be a value less than the resistance of the charged layer of the latent image carrier, the speed of charge response during latent image formation is hard to be affected by resistive components adhering to the surface layer of the writing electrode because the resistance of the charged layer is greater than the resistance of the writing electrode.

By setting the resistance value of the writing electrode at $10^8$ Ω cm or less, a predetermined time constant can be ensured, thus achieving uniform charge. On the other hand, by setting the resistance value of the writing electrode at $10^6$ Ω cm or more, the electrostatic breakdown due to pin holes of the charged layer of the latent image carrier can be prevented.

The setting of the resistance of the charged layer at $10^9$ Ω cm or less can facilitate application of charge which is conducted through the contact charge-transfer between the electrode and the latent image carrier which are in contact with each other.

Furthermore, the writing electrode on the conductive pattern is provided with the resistant layer, thereby preventing the broadening of the contact charge-transfer in the lateral direction. This achieves effective contact charge-transfer between the writing electrode and the latent image carrier.

Moreover, since the writing device employs only the writing electrodes without using a laser beam generating device or a LED light generating device which is large in size as conventionally used, the apparatus size can be reduced and the number of parts can also be reduced, thereby obtaining an image forming apparatus which is simple and low-price.

What we claim is:

1. An image forming apparatus comprising at least: a latent image carrier on which an electrostatic latent image is formed, a writing device for writing said electrostatic latent image on said latent image carrier, and a developing device for developing said electrostatic latent image on said latent image carrier, wherein said electrostatic latent image, written on said latent image carrier by said writing device, is developed by said developing device, thereby forming an image, said image forming apparatus being characterized in that said writing device has writing electrodes which are in plane contact with a charged layer of said latent image carrier to write said electrostatic latent image.

2. An image forming apparatus as claimed in claim 1, being characterized in that said writing electrodes are supported by a substrate having elasticity and are kept in contact with said latent image carrier by a small pressing force due to the elasticity of said substrate.

3. An image forming apparatus as claimed in claim 1 or 2, being characterized in that said writing electrodes write said electrostatic latent image on said latent image carrier by applying charge to said latent image carrier.

4. An image forming apparatus as claimed in claim 1 or 2, being characterized in that said writing electrodes write said electrostatic latent image on said latent image carrier by removing charge from said latent image carrier.

5. An image forming apparatus as claimed in claim 3, being characterized in that said writing electrodes are controlled to be connected to either high voltage or low voltage by switching operation in accordance with the image to be formed, thereby writing said electrostatic latent image on said latent image carrier.

6. An image forming apparatus as claimed in claim 1, being characterized in that the resistance value of said each writing electrode is set at a value smaller than the resistance value of said charged layer.

7. An image forming apparatus as claimed in claim 1, being characterized in that the resistance value of said each writing electrode is set at $10^8$ Ω cm or less.

8. An image forming apparatus as claimed in claim 1, being characterized in that the resistance value of said each writing electrode is set at $10^6$ Ω cm or more.

9. An image forming apparatus as claimed in claim 1, being characterized in that the resistance value of said charged layer is set at $10^9$ Ω cm or less.

10. An image forming apparatus as claimed in claim 1, being characterized in that said each writing electrode is provided with a resistive layer at its conductive portion so that said writing electrode is formed in a multi-layered structure, wherein said resistive layer of said writing electrode is in contact with said latent image carrier.

11. An image forming apparatus as claimed in claim 1, being characterized in that said writing device and said developing device are provided for every color of black, yellow, magenta, and cyan, whereby a multicolored developing powder image is formed by superposing respective color developing powder images which are formed by said writing devices for the respective colors and said developing devices for the respective colors.

12. An image forming apparatus as claimed in claim 1, being characterized in that said latent image carrier, said writing device, and said developing device are provided for every color of black, yellow, magenta, and cyan, whereby four image forming units for the respective colors are provided, said image forming units being arranged in tandem.

13. An image forming apparatus as claimed in claim 12, being characterized by further comprising an intermediate transferring device, to which respective color developing powder images are temporally transferred by said image forming units for the respective colors.

* * * * *